US009302404B2

(12) United States Patent
Matsushima et al.

(10) Patent No.: US 9,302,404 B2
(45) Date of Patent: Apr. 5, 2016

(54) APPARATUS AND NON-TRANSITORY COMPUTER-READABLE MEDIUM

(71) Applicant: BROTHER KOGYO KABUSHIKI KAISHA, Nagoya-shi (JP)

(72) Inventors: Mika Matsushima, Ichinomiya (JP); Masayuki Hori, Gifu (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/288,109

(22) Filed: May 27, 2014

(65) Prior Publication Data

US 2014/0352559 A1 Dec. 4, 2014

(30) Foreign Application Priority Data

May 28, 2013 (JP) ..... 2013-111869

(51) Int. Cl.

| | |
|---|---|
| ***B31F 1/07*** | (2006.01) |
| ***B26D 5/00*** | (2006.01) |
| ***B26D 7/26*** | (2006.01) |
| ***B26F 1/38*** | (2006.01) |
| ***B41J 11/66*** | (2006.01) |
| ***B41J 3/28*** | (2006.01) |
| *B26D 5/02* | (2006.01) |
| *B26D 7/01* | (2006.01) |

(52) U.S. Cl.

CPC *B26D 5/005* (2013.01); *B26D 7/26* (2013.01); *B26F 1/3813* (2013.01); *B41J 3/28* (2013.01); *B41J 11/66* (2013.01); *B26D 5/02* (2013.01); *B26D 7/015* (2013.01); *B26D 2005/002* (2013.01); *B26D 2007/2678* (2013.01)

(58) Field of Classification Search

CPC ..... B26D 5/00; B26D 7/01; B26D 7/26; B26D 7/15; B26D 5/005; B26D 2005/002; B26D 2007/2678; G05B 19/4068; B23Q 15/00; B26F 1/3813; B41J 11/66; B41J 3/28

See application file for complete search history.

(56) References Cited

U.S. PATENT DOCUMENTS

| | | | |
|---|---|---|---|
| 4,583,181 | A | 4/1986 | Gerber et al. |
| 4,739,487 | A | 4/1988 | Bonnet et al. |
| 5,258,917 | A | 11/1993 | Bruder et al. |
| 5,663,885 | A | 9/1997 | Stahl et al. |

(Continued)

FOREIGN PATENT DOCUMENTS

| | | | |
|---|---|---|---|
| EP | 0950480 | A2 | 10/1999 |
| JP | 2010-264571 | A | 11/2010 |

(Continued)

*Primary Examiner* — Matthew G Marini

(74) *Attorney, Agent, or Firm* — Fox Rothschild LLP

(57) ABSTRACT

An apparatus includes a moving device moving a holding member and a cutting or printing head relative to each other. The apparatus specifies, as a designated position, a position of an ultrasonic source located within a projection range on the holding member. The apparatus determines an edit pattern to be applied to an object based on the designated position to be specified and also determines a cutting or printing position on the object based on the designated position to be specified. The edit pattern is projected onto a holding region of the holding member and a menu image is projected onto an edge region of the holding member. The apparatus edits the edit pattern according to editing contents and generates data to perform cutting or printing on the object. The apparatus controls the moving device based on the generated data.

10 Claims, 14 Drawing Sheets

(56) References Cited

U.S. PATENT DOCUMENTS

| | | | | |
|---|---|---|---|---|
| 5,831,857 | A | 11/1998 | Clarino et al. | |
| 6,293,677 | B1 | 9/2001 | Gallucci | |
| 2002/0002416 | A1* | 1/2002 | Herman, Jr. | 700/135 |
| 2004/0160429 | A1* | 8/2004 | Blake et al. | 345/179 |
| 2005/0186010 | A1* | 8/2005 | Shibata et al. | 400/621 |
| 2005/0256603 | A1 | 11/2005 | Cloud et al. | |
| 2007/0293975 | A1* | 12/2007 | Hama | 700/134 |
| 2010/0103178 | A1* | 4/2010 | Song et al. | 345/473 |
| 2011/0141067 | A1 | 6/2011 | Misawa et al. | |
| 2012/0253504 | A1 | 10/2012 | Kawaguchi et al. | |
| 2013/0177215 | A1 | 7/2013 | Campbell et al. | |
| 2014/0352511 | A1 | 12/2014 | Yamanashi et al. | |

FOREIGN PATENT DOCUMENTS

| | | | |
|---|---|---|---|
| JP | 2011-005579 | A | 1/2011 |
| JP | 2011-125971 | A | 6/2011 |
| JP | 2012-136811 | A | 7/2012 |
| JP | 2013-013977 | A | 1/2013 |
| JP | 2013-240838 | A | 12/2013 |
| JP | 2014-231102 | A | 12/2014 |

* cited by examiner

| | |
|---|---|
| COLOR DATA | R VALUE |
| | G VALUE |
| | B VALUE |
| SIZE DATA | LONGITUDINAL |
| | TRANSVERSE |
| CUTTING LINE DATA | FIRST COORDINATE DATA |
| | SECOND COORDINATE DATA |
| | THIRD COORDINATE DATA |
| | ⋮ |
| | (N+1)-TH COORDINATE DATA |

FIG.10

APPARATUS AND NON-TRANSITORY COMPUTER-READABLE MEDIUM

CROSS-REFERENCE TO RELATED APPLICATIONS

This application is based upon and claims the benefit or priority from the prior Japanese Patent Application No. 2013-111869 filed on May 28, 2013, the entire contents of which are incorporated herein by reference.

BACKGROUND

1. Technical Field

The present disclosure relates to an apparatus performing cutting or printing on an object and a non-transitory computer-readable medium.

2. Related Art

Cutting plotters have been conventionally known as an apparatus performing cutting or printing on an object. One of the cutting plotters automatically executes a cutting process for the object including a sheet such as paper.

The cutting plotter is provided with a display. A user selects a desired one of a plurality of patterns displayed on the display. The sheet is attached to a holding sheet having an adhesive layer on a surface thereof. The holding sheet is inserted between a driving roller of a drive mechanism and a pinch roller both disposed one above the other. The cutting plotter moves the sheet in a first direction while holding both ends of the sheet between the rollers. The cutting plotter simultaneously moves a carriage with a cutting blade in a second direction perpendicular to the first direction, whereby the selected pattern is cut out of the sheet.

SUMMARY

In order that processing conditions such as a cutting position of the pattern on the sheet may be changed, the cutting plotter needs to read cutting data of the pattern to check and designate processing conditions. For example, when a cutting position is changed, the user operates the cutting plotter while viewing the display. The pattern is displayed in a reduced size one to limitation in the size of the display. Accordingly, a changed cutting position cannot sometimes be understood correctly depending upon the pattern. Furthermore, a plurality of operation switches provided on the cutting plotter needs to be used for editing a pattern such as the change of processing position with the result that the operation becomes complicate.

Therefore, an object of the disclosure is to provide an apparatus which can easily edit a pattern which is cut out of the object or printed on the object and a non-transitory computer-readable medium storing data of instructions for the apparatus.

The disclosure provides an apparatus performing cutting or printing on an object, including a moving device configured to move a holding member and a cutting head or a printing head relative to each other, the holding member being set to the apparatus while holding the object, a detection device configured to detect ultrasonic waves, a projection device configured to be capable of projecting information about a pattern onto a predetermined projection range, and a control device. The control device is configured to cause the apparatus to specify, as a designated position, a position of an ultrasonic source located within the projection range on the holding member, based on the detected ultrasonic waves with the holding member being positioned, the projection range including a holding region holding the object on the holding member and an edge region located outside the holding region on the holding member, to determine an edit pattern which is a pattern to be applied to the object, based on the designated position to be specified, to determine a cutting position or a printing position on the object based on the designated position to be specified, to cause the projection device to project the edit pattern onto a corresponding position on the holding region and a menu image onto the edge region, the corresponding position serving as the cutting position or the printing position of the edit pattern, the information about the pattern including the determined edit pattern and the menu image representing a plurality of items to edit the edit pattern to edit the edit pattern according to editing contents represented by an applicable one of items in the menu image projected onto the edge region when a position corresponding to the applicable item has been specified, based on the position which has been specified as the designated position and which is on the edge region within the projection range, to generate data to perform cutting or printing on the object based on the determined edit pattern or the edited edit patten and the cutting or the printing position, and to control the moving device based on the generated data to move the holding member and the cutting head or the printing head relative to each other, thereby performing cutting or printing on the object.

The disclosure also provides a non-transitory computer-readable medium storing a program for an apparatus including a moving device configured to move a holding member and a cutting head or a printing head relative to each other, the holding member being set to the apparatus while holding the object, a detection device configured to detect ultrasonic waves, a projection device configured to be capable of projecting information about a pattern onto a predetermined projection range, and a control device. The program causes the control device to execute instructions which, when executed, cause the apparatus to specify, as a designated position, a position of an ultrasonic source located within the projection range on the holding member, based on the detected ultrasonic waves with the holding member being positioned, the projection range including a holding region holding the object on the holding member and an edge region located outside the holding region on the holding member, to determine an edit pattern which is a pattern to be applied to the object, based on the designated position to be specified, to determine a cutting position or a printing position on the object based on the designated position to be specified, to cause the projection device to project the edit pattern onto a corresponding position on the holding region and a menu image onto the edge region, the corresponding position serving as the cutting position or the printing position of the edit pattern, the information about the pattern including the determined edit pattern and the menu image representing a plurality of items to edit the edit pattern, to edit the edit pattern according to editing contents represented by an applicable one of items in the menu image projected onto the edge region when a position corresponding to the applicable item has been specified, based on the position which has been specified as the designated position and which is on the edge region within the projection range, to generate data to perform cutting or printing on the object based on the determined edit pattern or the edited edit pattern and the cutting or the printing position, and to control the moving device based on the generated data to move the holding member and the cutting head or the printing head relative to each other, thereby performing cutting or printing on the object.

BRIEF DESCRIPTION OF THE DRAWINGS

In the accompanying drawings:

FIG. 10 is a view explaining the structure of processing data;

DETAILED DESCRIPTION

Figure 1:
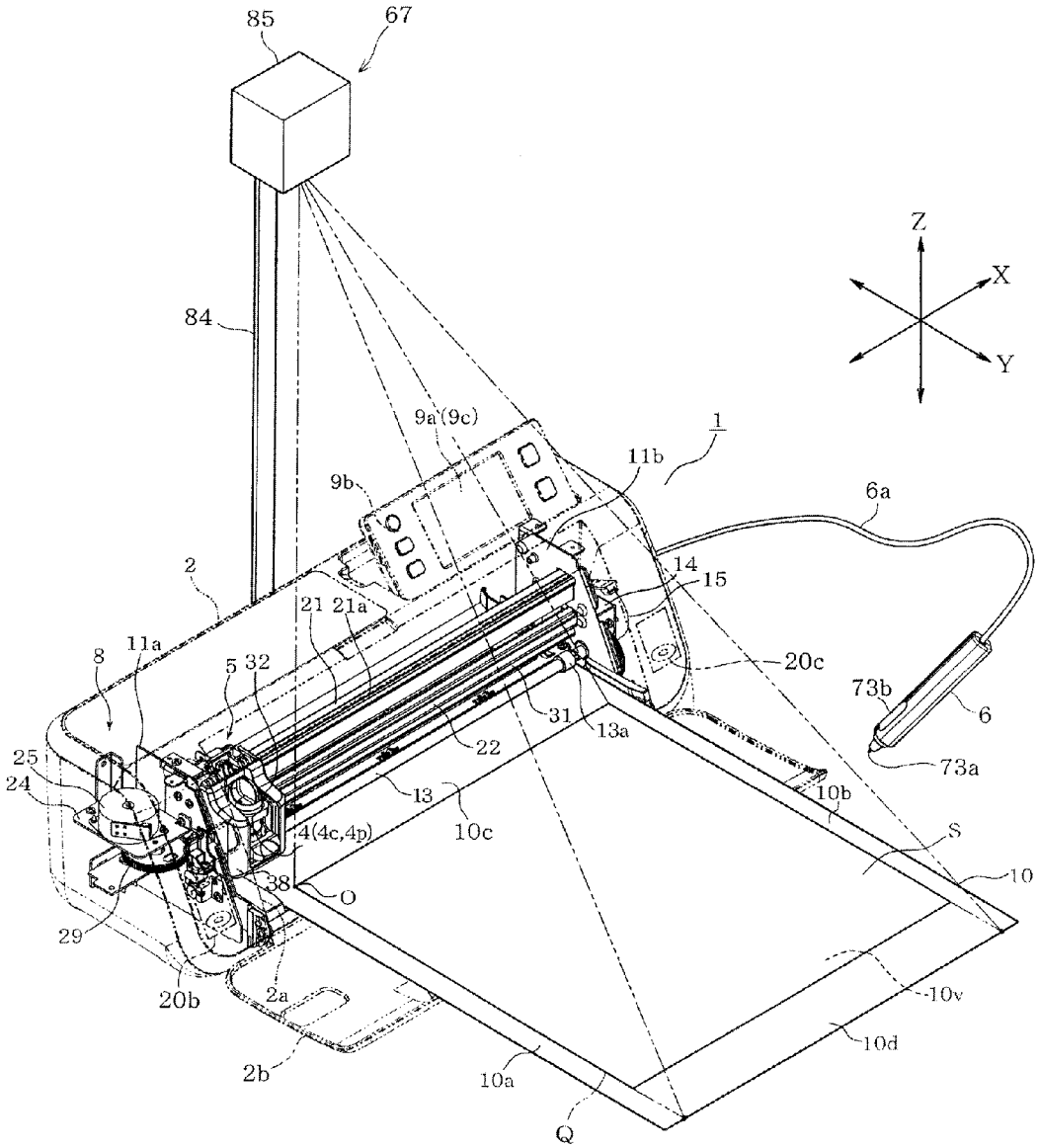
FIG. 1 is a perspective view of a processing apparatus, showing an entire structure thereof.

A first embodiment of the apparatus will be described with reference to FIGS. 1 to 17. Referring to FIG. 1, a processing apparatus 1 is shown and includes a body cover 2 serving as a housing, a platen 3 (see FIG. 2) provided in the body cover 2 and a processing head 5 on which a cartridge 4 is to be mounted. The processing apparatus 1 further includes a holding sheet 10 for holding an object S to be processed.

A plurality of cutter cartridges 4*c* and a plurality of pen cartridges 4*p* are prepared as the cartridge 4 in the processing apparatus 1. One of the cartridges 4*c* and 4*p* is selectively attached to a cartridge holder 32 of the processing head 5 as will be described later. All the cartridges 4*c* and 4*p* include respective cases 50 having substantially the same shape (see FIGS. 4A and 4B). All the cartridges 4*c* and 4*p* will be hereinafter referred to as "cartridge 4" for the sake of simplicity.

The processing apparatus 1 is provided with an ultrasonic digital pen 6 which is used to designate a position on the object S held on the holding sheet 10. The ultrasonic pen 6 is configured to transmit ultrasonic waves. A connector (designated by reference numeral 70 in FIG. 9) is provided on a side of the body cover 2. The ultrasonic pen 6 has a cable 6*a* which is connected to the connector 70. The body cover 2 has a front formed with receivers 20*c* and 20*b* located on right and left ends thereof respectively. The receivers 20*b* and 20*c* are configured to receive the ultrasonic waves transmitted by the ultrasonic pen 6. The ultrasonic pen 6 and the receivers 20*b* and 20*c* will be described in detail later.

The body cover 2 is formed into the shape of a horizontally long rectangular box. The body cover 2 has a front formed with an opening 2*a*. A front cover 2*b* is mounted on the front of the body cover 2 to open and close the opening 2*a*. The holding sheet 10 holding the object S is set onto the platen 3 while the front opening 2*a* is open or the cartridge 4 is attached to or detached from the cartridge holder 32.

The processing apparatus 1 includes a transfer mechanism 7 which transfers the holding sheet 10 set on the platen 3 in a predetermined transfer direction (the Y direction). The processing apparatus 1 also includes a head moving mechanism 8 which moves the processing head 5 in a direction intersecting with the transfer direction of the holding sheet 10 (for example, the X direction perpendicular to the transfer direction). In the following description, the direction in which the holding sheet 10 is transferred by the transfer mechanism 7 will be referred to as "front-rear direction". That is, the front-rear direction is the Y direction and the right-left direction perpendicular to the Y direction is the X direction.

A liquid-crystal color display 9*a* and an operation device 9*b* including various operation switches are mounted on a right upper surface of the body cover 2. The display 3*a* is capable of full color display and is configured to display various patterns, conditions for cutting and printing (processing conditions), necessary messages to the user, and the like. A touch panel 9*c* is placed on a display surface side of the display 9*a*. The operation device 9*b* or the touch panel 9*c* is operated by the user when various input contents are entered. A touch panel 9*c* is placed on a display surface side of the display 9*a*. When operating the operation switches of the operation device 9*b* or the touch panel 9*c*, the user can designate an object to be displayed on a screen of the display 9*a*, select various patterns, set various parameters, and the like.

Figure 2:
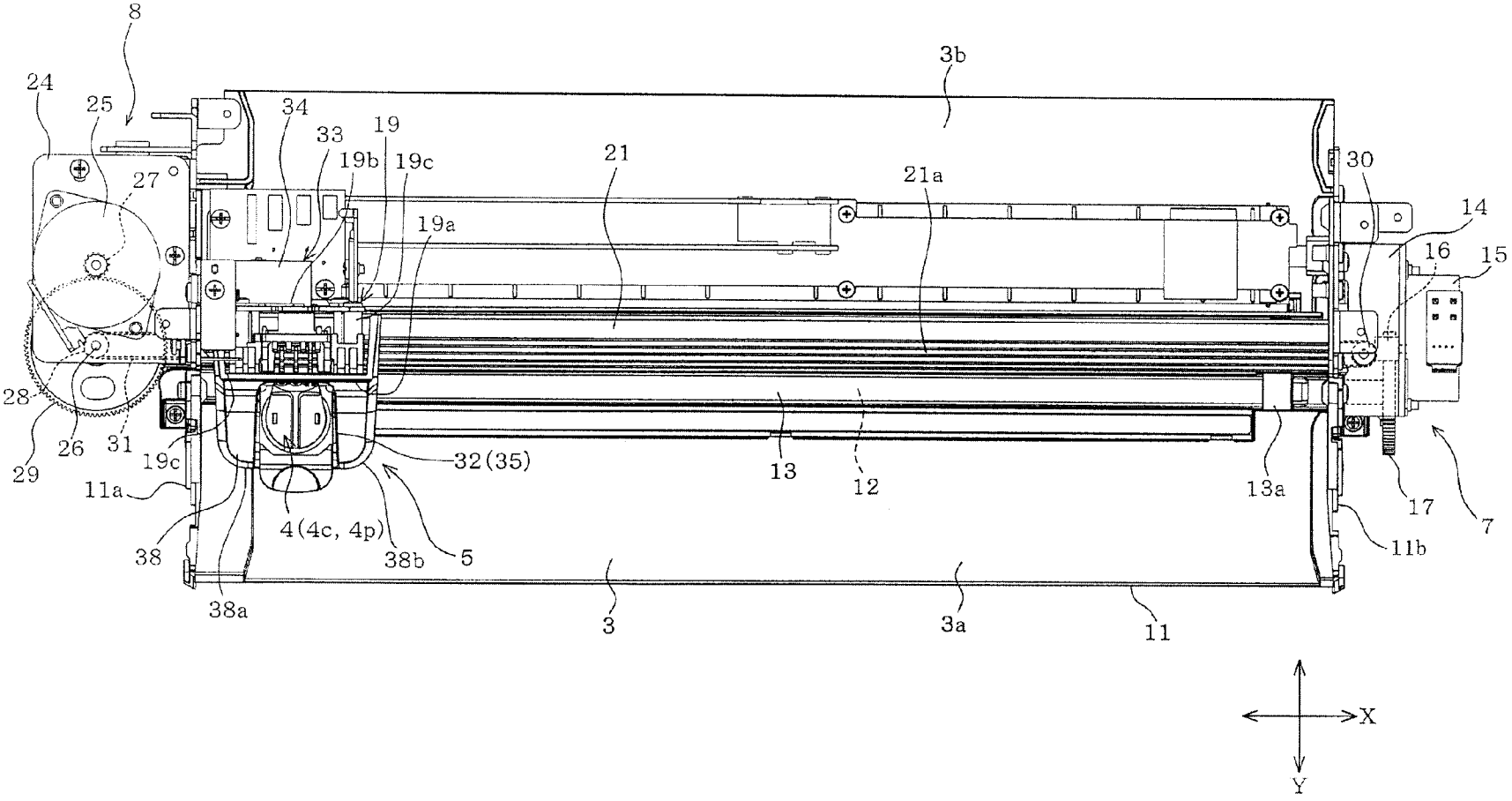
FIG. 2 is a plan view of the processing apparatus, showing the inner structure thereof.

The platen 3 receives the underside of the holding sheet 10 when the object S is processed. The platen 3 includes a front platen 3*a* and a rear platen 3*b* and has a horizontal upper surface as shown in FIG. 2. The holding sheet 10 holding the object S is transferred while being placed on the platen 3. The holding sheet 10 is made of a synthetic resin material, for example and formed into a rectangular shape. An adhesive layer 10*v* (see FIGS. 1 and 14) is provided on an upper side of the holding sheet 10. The adhesive layer 10*v* is formed by applying an adhesive agent to an inner region of the holding sheet 10 except for peripheral edges 10*a* to 10*d*. The holding sheet 10 serves as a holding member which holds the object S attached to the adhesive layer 10*v*. The adhesive layer 10*v* has an adhesive force which is set so that the object S is movably held reliably in the cutting or printing process by the use of the cartridge 4 of the cutter 44 or the printing and so that the object S can be easily removed after the processing. The transfer mechanism 7 and the head moving mechanism 8 are constructed into a moving device which moves the holding sheet 10 holding the object S in the X direction and the processing bead 5 in the X and Y directions relative to each other.

The transfer mechanism 7 transfers the holding sheet 10 on the upper surface side of the platen 3 freely in the Y direction. A frame 11 is enclosed in the body cover 2 as shown in FIGS. 1 and 2. The frame 11 includes right and left sidewalls 11*b* and 11*a* which are located at right and left sides of the platen 3 so as to face each other, respectively. A driving roller 12 and a pinch roller 13 are mounted on both sidewalls 11*a* and 11*b* so as to be located in a space between the front and rear platens 3*a* and 3*b*. The driving roller 12 and the pinch roller 13 extend in the right-left direction and lined in the up-down direction. The pinch roller 13 is located above the driving roller 12.

The driving roller 12 has an upper end which is substantially level with the upper surface of the platen 3 and right and left ends mounted on the right and left sidewalls 11*b* and 11*a* respectively so that the driving roller 12 is rotatable. The right end of the driving roller 12 extends right ward through the right sidewall 11*b* as shown in FIG. 2. A driven gear 17 having a large diameter is secured to a right end of the driving roller 12. Amounting frame 14 is fixed to an outer surface of the right sidewall 11*b*. A Y-axis motor 15 comprised of a stepping motor, for example is mounted on the mounting frame 14. The Y-axis motor 15 has an output shaft to which is fixed a driving gear 16 having a small diameter and is to be brought into mesh engagement with the driven gear 17.

The pinch roller 13 has right and left ends mounted on the right and left sidewalls 11*b* and 11*b* respectively so that the pinch roller 13 is rotatable and slightly displaceable in the up-down direction. Two springs (not shown) are mounted on the outer surfaces of the right and left sidewalls 11*b* and 11*a* to normally bias the right and left ends of the pinch roller 13 downward. Accordingly, the pinch roller 13 is normally biased downward (to the driving roller 12 side) by the springs. Two rollers 13*a* each having a slightly large diameter are mounted on the pinch roller 13 so as to be located near both ends thereof respectively. Only the right roller 13*a* is shown in FIGS. 1 and 2.

The right and left edges 10*b* and 10*a* of the holding sheet 10 are thus held between the driving roller 12 and the rollers 13*a* of the pinch roller 13. Upon normal or reverse rotation of the Y-axis motor 15, the rotation is transmitted via the gears 16 and 17 to the driving roller 12, whereby the holding sheet 10 is transferred rearward or forward. The transfer mechanism 7 is thus constituted by the driving roller 12, the pinch roller 13, the Y-axis motor 15 and the gears 16 and 17 serving as a reduction mechanism.

The head moving mechanism 8 serves to move the carriage 19 of the processing head 5 freely in the X direction. A pair of guide rails 21 and 22 are fixed to the right and left sidewalls 11*b* and 11*a* so as to be located slightly rear above the pinch roller 13, as shown in FIGS. 1 and 2. The guide rails 21 and 22 extend in the right-left direction substantially in parallel to the pinch roller 13. Guide grooves are formed in an upper surface of the guide rail 21 and an underside of the guide rail 22 so as to extend between the right and left ends although only the guide groove 21*a* of the upper surface is shown.

Furthermore, the carriage 19 has a pair of protrusions engaging the guide grooves 21*a* respectively although the guide grooves are not shown. The protrusions are formed on the upper and lower sides so as to hold, the guide grooves 21*a* therebetween in the up-down direction. Thus, the carriage 19 is supported by the engagement of the protrusions and the guide grooves 21*a* so as to be slidable on the guide rails 21 and 22 in the right-left direction.

A horizontal mounting frame 24 is fixed to the outer surface of the left sidewall 11*a* so as to be located near the rear of the left sidewall 11*a* at the outer surface side, as shown in FIGS. 1 and 2. An X-axis motor 25 is mounted on a rear part of the left mounting frame 24 to a downward direction. Furthermore, a vertically extending pulley shaft 26 (see FIG. 2) is mounted on the mounting frame 24. The X-axis motor 25 is comprised of a stepping motor, for example and has an output shaft to which a driving gear 27 having a small diameter is fixed. A timing pulley 28 and a driven gear 29 having a large diameter are rotatably mounted on the pulley shaft 26. The timing pulley 28 and the driven gear 29 are configured to foe rotated together.

On the other hand, a timing pulley 30 is mounted on the right mounting frame 14 so as to be rotatable about an axis extending in the up-down direction. An endless timing belt 31 horizontally extends between the timing pulleys 30 and 28 in the right-left direction. The timing belt 31 has a midway part joined to a mounting part (not shown) of the carriage 19.

Upon normal or reverse rotation of the X-axis motor 25, the rotation is transmitted via the gears 27 and 29 and the timing pulley 28 to the timing belt 31, whereby the processing head 5 is moved leftward or rightward. Thus, the carriage 19 is moved freely in the right-left direction perpendicular to the direction in which the object S is conveyed. The head moving mechanism 8 is thus constituted by the guide rails 21 and 22, the X-axis motor 25, the gears 27 and 29 serving as a reduction mechanism, the timing pulleys 28 and 30, the timing belt 31 and the like.

Figure 3:
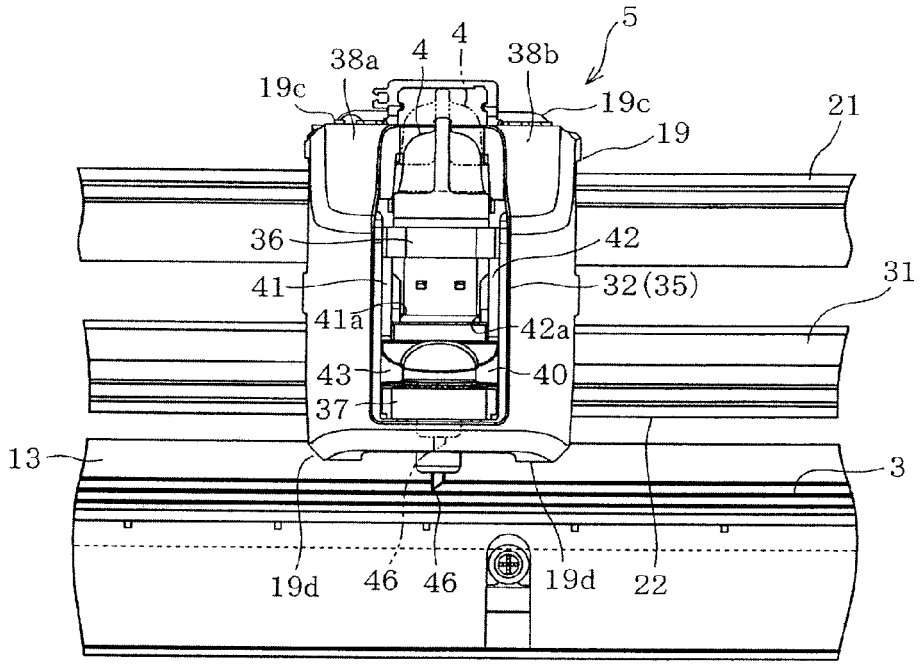
FIG. 3 is a front view of a processing head and its periphery.
Figure 5:
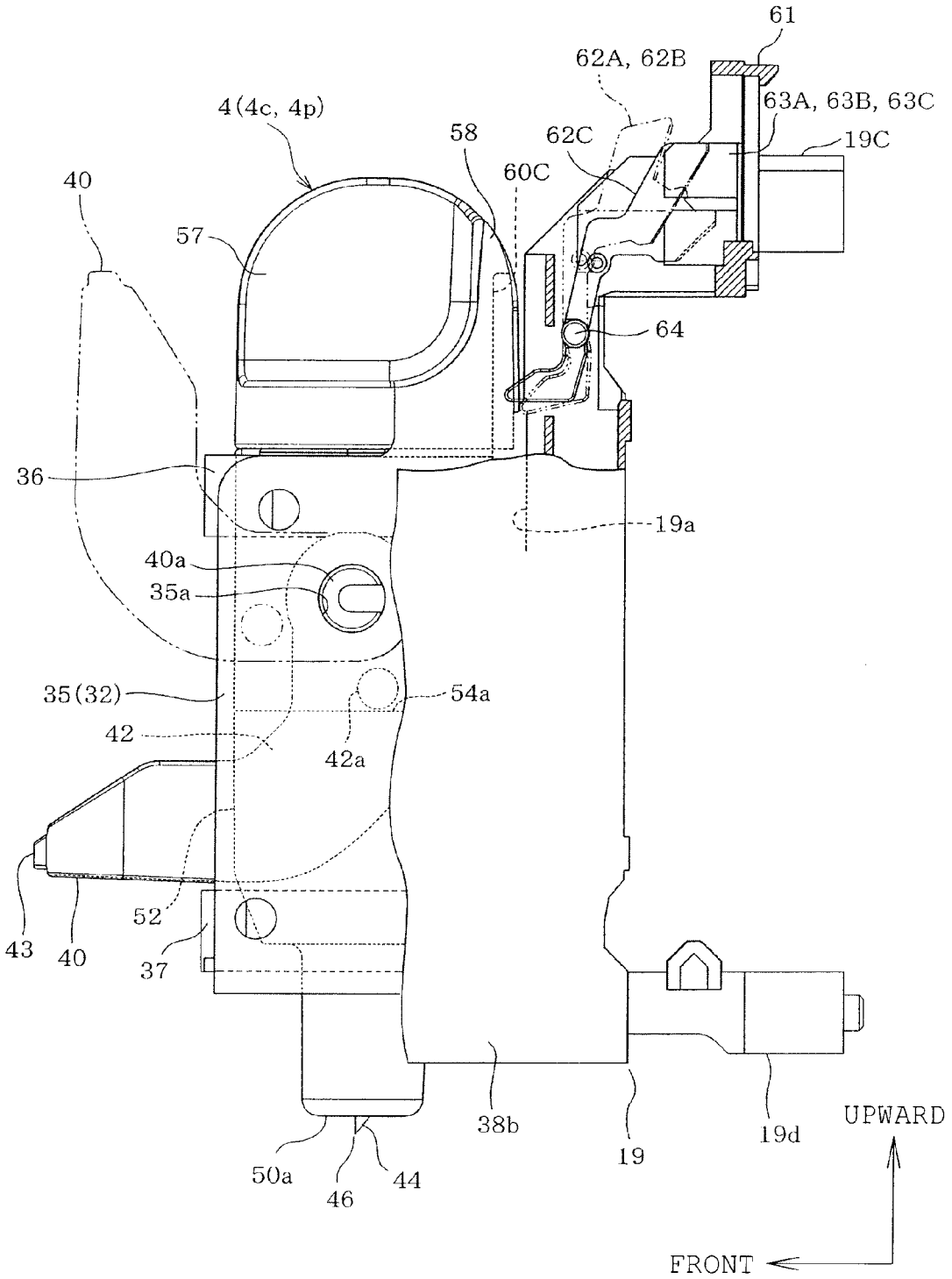
FIG. 5 is a right side view of a cartridge holder and its vicinity with a cover member being partially broken in the state where the cartridge is attached.

The processing head 5 includes an up-down drive mechanism 33 and a cartridge holder 32 disposed in the rear and in front of the carriage 19 as shown in FIG. 2. The up-down drive mechanism 33 is configured to drive the cartridge holder 32 in the up-down direction (the Z direction) together with the cartridge 4. The carriage 19 includes front and rear walls 19*a* and 19*b* and upper and lower arms 19*c* and 19*d* connecting the wails 19*a* and 19*b*, as shown in FIGS. 2, 3 and 5. Thus, the carriage 19 is shaped so as to surround the front and rear sides and upper and lower sides of the guide rails 21 and 22. A Z-axis motor 34 (see FIG. 2) is mounted on the rear wall 19*b* so that an axis thereof is directed frontward. The Z-axis motor 34 is comprised of a stepping motor, for example. A transmission mechanism (not shown) is provided between the Z-axis motor 34 and the cartridge holder 32. The transmission mechanism reduces a rotational speed of the Z-axis motor 34 and converts rotation of the Z-axis motor 34 to up-down movement of the cartridge holder 32, transmitting the up-down movement. The transmitting mechanism and the Z-axis motor 34 constitute the up-down drive mechanism 33.

Figure 4A:
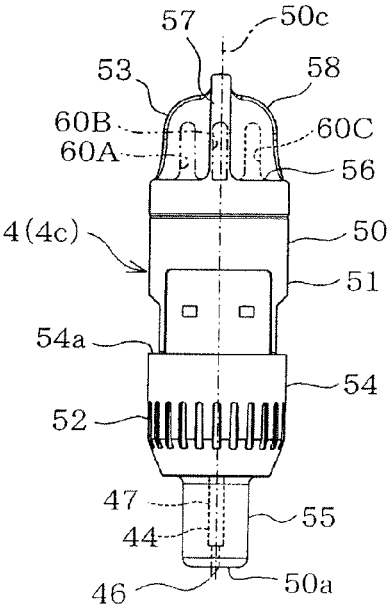
FIGS. 4A and 4B are front views of examples of a cutter cartridge and a pen cartridge respectively.
Figure 4B:
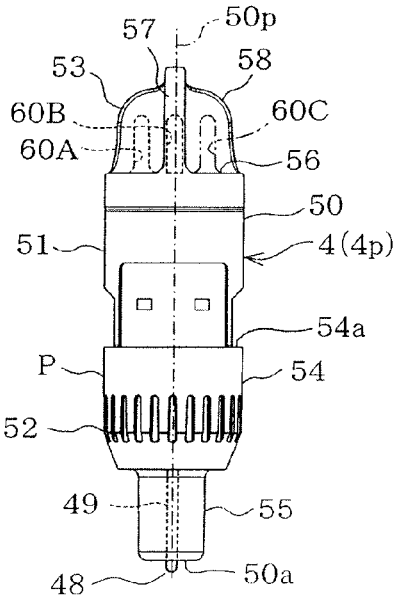

Upon normal or reverse rotation of the Z-axis motor 34, the rotation is converted via the transmission mechanism to the up-down movement, whereby the cartridge holder 32 is moved upward or downward together with the cartridge 4. As a result, the cartridge holder 32 is moved together with the cartridge 4 between a lowered position and a raised position (see two-dot chain line in FIG. 3). When located at the lowered position, the cartridge 4 of the cartridge holder 32 carries out cutting by a cutter 44 or printing by a pen 45 as shown in FIGS. 4A and 4B. When the cartridge 4 of the cartridge holder 32 is located at the raised position, the blade edge 46 or the pen tip 48 is spaced away from the object S by a predetermined distance.

When the cutter cartridge 4*c* is attached to the cartridge holder 32 and is located at the lowered position, the blade edge 46 penetrates the object S. On the other hand, when the pen cartridge 4*p* is attached to the cartridge holder 32 and is located at the lowered position, the pen tip 43 abuts on the object S. Pressure of the blade edge 46 and pressure of the pen tip 48 will be set to be suitable for the cutting and the printing based on an amount of rotation of the Z-axis motor 34, respectively.

The cartridge bolder 32 includes a holder frame 35 and upper and lower holders 36 and 37 both fixed to the holder frame 35 as shown in FIGS. 2, 3 and 5. More specifically, a cover member 38 is provided on the front wail 19*a* of the carriage 19 so as to cover right and left sides of the front wail 19*a* from front. The holder frame 35 serving as a movable part is disposed between a left projection part 38*a* and a right projection 38*b* of the cover member 38. The holder frame 35 is formed into such a shape (see FIG. 2) as to have a top, underside and front all of which ere open. The upper and lower holders 36 and 37 are attached so that the cartridge 4 is inserted through the both holders 36 and 37 from above. The upper and lower holders 36 and 37 are each formed into a frame shape housed in the holder frame 35.

The holder frame 35 is provided with a lever member 40 located between the upper and lower holders 36 and 37 as shown in FIGS. 3 and 5. The lever member 46 has a pair of right and left arms 42 and 41 and an operating portion 43 which is provided so as to connect between distal end sides of the arms 41 and 42. The lever member 60 has a proximal end formed with pivot portions 40*a* and 40*b* located at outer surface sides of the arms 41 and 42 respectively. Only the right pivot portion 40*a* is shown in FIG. 5. The holder frame 35 has right and left sidewalls formed with circular holes respectively. Only the right circular hole 35*a* is shown. The pivot portions 40*a* and 40*b* are inserted through circular holes 35*a* respectively. The arms 41 and 42 include respective inner surface sides provided with small columnar engagement portions 41*a* and 42*a* (see FIGS. 3 and 5). The engagement portions 41*a* and 42*a* are formed so as to be engageable with engaged portions 54*a* of the cartridge 4 respectively.

As a result, the lever member 46 is swung about the pivot portions 40*a* serving as a center of swinging motion so as to be switch able between an open position shown by alternate long and two short dashes line in FIG. 5 and a fixed position shown by solid line in FIG. 5. As shown in FIG. 5, the engagement portions 41*a* and 42*a* engage the engaged portions 54*a* respectively when the lever member 40 is located at the fixed position. As the result of the engagement, the cartridge 4 is fixed to the lower holder 37 (the cartridge holder 32). On the other hand, when operated so as to be pulled frontward, the lever member 40 is swung from the fixed position to the open position. With this swing, the engagement portions 41*a* and 42*a* depart from the respective engaged portions 54*a*, whereby the lever member 40 is released from the fixed state.

The cartridge 4 which is detachable attached to the cartridge holder 32 will now be described. FIGS. 4A and 48 exemplify cartridges 4*c* and 4*p* of the cutter 44 and the pen 45 respectively. As shown, the cartridge 4*c* of the cutter C and the cartridge 4*p* of the pen P include the same case 50 and are selectively attached to the cartridge holder 32. More specifically, the case 50 includes a case body 51, the cap 52 and a knob 53. The cap 52 and the knob 53 are provided on one end and the other end of the case body 51 respectively. The case body 51 is formed into a cylindrical shape and extends in the up-down direction.

The cap 52 includes a larger-diameter portion 54 and a smaller-diameter portion 55 and is accordingly formed into the shape of a stepped bottomed cylindrical container. The larger-diameter portion 54 is fitted with a lower end of the case body 51. The larger-diameter portion 54 has an upper end serving as an engaged portion 54*a* which abuts on the engagement portions 41*a* and 42*a* of the lever member 40. The larger-diameter portion 54 has a lower end which is fitted with the lower holder 37 of the cartridge holder 32. The cap 52 has an underside 50*a* formed into a flat shape. The underside 50*a* has a through hole (not shown) through which the blade edge 46 of the cutter 44 or the pen tip 48 is inserted. The knob 53 has a cover plate 56, a knob plate 57 and a rear plate 58 both provided on an upper part of the cover plate 56. The cover plate 56 is fixed to an upper end of the case body 51. The knob plate 57 is mounted on a central part of the cover plate 56 in the right-left direction so as to be directed vertically.

The cartridge 4*c* shown in FIG. 4A includes the cutter 44 serving as a cutting unit (a processing unit). The cutter 44 has a proximal end or a cutter shaft 47 and a distal end (a lower end) or the blade edge 46, both of which are formed integrally with the cutter 44. The cutter shaft 47 is formed into a round bar shape and is housed in the case 50. The blade of the cutter 44 is formed into a substantially triangular shape tilted relative to the object S although not shown in detail in the drawings. Furthermore, bearings are provided in the case body 51 to support the cutter shaft 47 so that the cutter shaft 47 is rotatable about a central axis 50*c* thereof. The blade edge 46 protrudes from the underside 50*a* of the cap 52. The cartridge 4*c* is constructed so that a central axis 50*c* of the cutter shaft 47 corresponds with a central axis of the cap 52.

The cartridge 4*p* shown in FIG. 4B is a printing instrument (a processing unit) and has a distal end or the pen tip 48 from which ink is caused to seep. An ink tank (not shown) is provided in the case body 51 to supply ink to a pen tip member 49. The pen tip 4*p* protrudes from the underside 50*a* of the cap 52. The cartridge 4*p* is constructed so that a central axis 50*p* of the pen tip 43 corresponds with a central axis of the cap 52.

Any one of three grooves 60A to 60C is formed in the rear plate 58 of the knob 53 so that the rear plate 58 is a concavo-convex portion, as shown in FIGS. 4A and 4B. The grooves 60A to 60C have different concavo-convex patterns according to types of the cartridges 4. More specifically, for example, the cutting cartridge 4*c* or the printing cartridge 4*p* can be discriminated based on presence or absence of the groove 60*c* at the right end of the rear plate 58, as shown in FIGS. 4A and 4B. In other words, for example, the cartridges 4*c* and 4*p* as shown in respective FIGS. 4A and 4B differ from each other in the presence or absence of the groove 60C at the right end of the rear plate 58. The groove 60C can discriminate between the cutting cartridge 4*c* and the printing cartridge 4*p*. Furthermore, for example, the color type of the pen 45 can be discriminated based on presence or absence of the grooves 60A and 60B of the cartridge 4*p*. In order that the type of the cartridge 4 may be discriminated, the number of grooves of the concavo-convex portion may be changed depending upon a color type of the cartridge 4, for example.

The carriage 10 is provided with a detection unit which is located at an upper side facing the rear plate 58 of the cartridge 4, as shown in FIG. 5. The detection unit may include, for example, three contacts 62A to 62C and three type detection sensors 63A to 63C all provided on a base plate holder 61.

The type detection sensors 63A to 63B are mounted on a substrate of the base plate holder 61 so as to be arranged from side to side. The type detection sensors 63A to 63C are comprised of optical sensors (photointerrupters). The contacts 62A to 62C are formed into the shape of a plate extending over the side of the type detection sensors 63A to 63C. The contacts 62A to 62C have lengthwise middle portions formed with shafts 64 respectively. The base plate holder 61 is provided with bearings (not shown) swingably supporting the shafts 64 respectively, whereby the contacts 62A to 62C are supported by the respective bearings so as to be lined in the direction of plate thickness. Three extension coil springs (not shown) extend between upper portions of the contacts 62A to 62C and the substrate holder 61 respectively. The contacts 62A to 62C are biased by the extension coil springs in a direction such that the upper portions of contacts 62A to 62C are tilted toward the type detection sensors 63A to 63C respectively. In other words, the biasing forces of the extension coil springs act in a direction such that lower ends of the contacts 62A to 62C come into contact with the rear plate 58 of the knob 53.

For example, when the cartridge 4*c* of the cutter 44 is attached to the cartridge holder 32, the lower ends of the contacts 62A and 62B come into contact with the rear plate 58, thereby swinging. With the swinging, the upper ends of the contacts 62A and 62B are departed from the type detection sensors 63A and 63B respectively (see two-dot chain line in FIG. 5). On the other hand, the lower end of the other contact 62C remains tilted toward the groove 60C of the rear plate 58. Accordingly, the upper end of the contact 62*c* is fitted at the type detection sensor 63C side.

The cutter cartridge 4*c* is attached to the cartridge holder 32 in cutting the object S. In this case, the control circuit 31 identifies the type of the cutter cartridge 4*c*, based on detection signals of the contacts 62A to 62C generated by the type detection sensors 63A to 63C respectively. The control circuit 71 then controls the up-down drive mechanism 33 to move the cutter cartridge 4*c* to the lowered position and sets the blade edge 46 to the above-mentioned cutter pressure. In this case, the blade edge 46 penetrates the object S on the holding sheet 10 to be put slightly into the holding sheet 10. In this state, the holding sheet 10 acid the cutter cartridge 4*c* are moved in the X and Y directions relative to each other by the transfer mechanism 7 and the head moving mechanism 8, respectively. The cutting of the object S is executed by this relative movement.

On the other hand, when the pen cartridge 4*p* is attached to the cartridge holder 32 in printing a pattern on the object S, the control circuit 71 identifies the type of the pen cartridge 4*p*, based on detection signals of the contacts 62A to 62C generated by the type detection sensors 63A to 63C respectively. The control circuit 71 then controls the up-down drive mechanism 33 to move the pen cartridge 4*p* to the lowered position and sets the pen tip 48 to the above-mentioned pen pressure. In this case, the pen tip 48 penetrates the object S. In this state, the holding sheet 10 and the pen cartridge 4*p* are moved in the X and x directions relative to each other by the transfer mechanism 7 and the head moving mechanism 8, respectively. The printing of the object S is executed by this relative movement.

A sheet sensor 66 (see FIG. 9) is provided on the underside of the carriage 19 for detecting the holding sheet 10 set on the platen 3 (the Y direction position of the sheet 10). A detection signal generated by the sheet sensor 66 is supplied to the control circuit 71. An X-Y coordinate system with a left corner of the adhesive layer 10*v* serving as an origin O is set in the processing apparatus 1, as shown in FIG. 1. The above-described relative movement of the holding sheet 10 (the object S) and the processing head 5 (the cartridge 4) is carried out on the basis of the X-Y coordinate system. In this case, the processing head 5 functions as a cutting head or a printing head according to a type of the cartridge 4*c* or 4*p* attached to the cartridge holder 32.

Both a pattern to be cut out of the object S or printed on the object S and a processing position of the pattern can be edited in the processing apparatus 1 of the embodiment. An image of the pattern edited by the ultrasonic pen 6 can be projected onto a processing position on the object S by a projector 67 as shown in FIG. 1.

In the processing apparatus 1 of the embodiment, a position on the object S to which a cutting or printing operation is applied is represented on the object S by a projector 67 as shown in FIG. 1. Furthermore, any position on the object S is designated by the ultrasonic pen 6. The designated position is detected by the receivers 20*b* and 20*c* thereby to be set as the processing position.

The ultrasonic pen 6, the receivers 20*b* and 20*c* and the projector 67 will be described in detail with reference to FIGS. 6 and 9. A cable 6*a* has two ends, one of which is connected to the ultrasonic pen 6 and the other of which is connected to a connector 70. Thus, the ultrasonic pen 6 is supplied with electric power from the processing apparatus 1 side when connected via the cable 6*a* to the connector 70 (see FIG. 9). On the other hand, the ultrasonic pen 6 supplies an electrical signal to the cutting apparatus 1 side.

Figure 6:
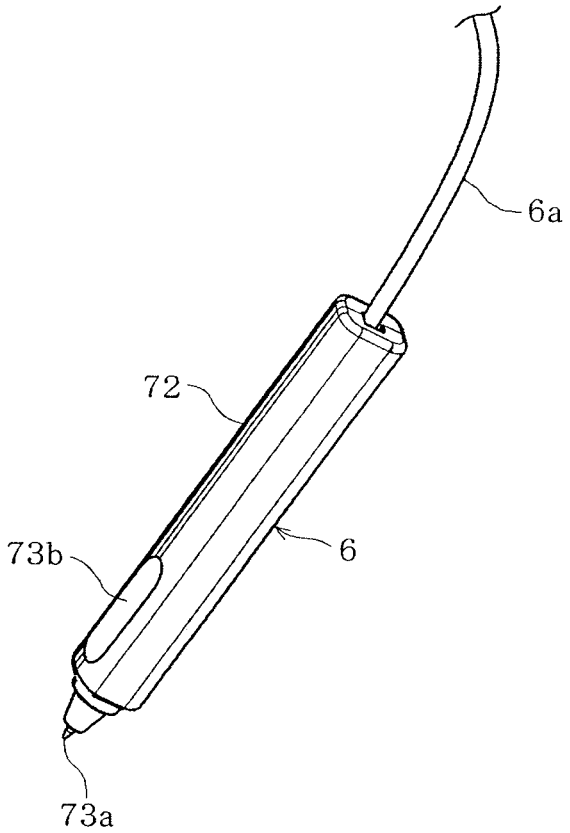
FIG. 6 is a perspective view of an ultrasonic digital pen.

The ultrasonic pen 6 includes a pen body 72 and the pen tip 73*a* as shown in FIG. 6. The pen body 72 is formed into a bar shape and has a distal end. The pen tip 73*a* which is tapered and has a pointed distal end is provided at the distal end side (the lower end side in FIG. 6) of the pen body 72. The pen tip 73*a* projects so as to be capable of penetrating the pen body 72 in the lengthwise direction with the result that the pen tip 73*a* can be caused to abut on the object and inserted into the pen body 72. A biasing member is provided in the pen body 72 for biasing the pen tip 73*a* in a direction such that the pen tip 73*a* protrudes from the pen body 72 although not shown. When released from the protruding force, the biasing force of the biasing member returns the pen tip 73*a* to the original protruding position. Furthermore, a button 73*b* is provided on a part of the pen body 72 located nearer the pen tip 73*a*. While holding the ultrasonic pen 6 with his/her hand, the user can push the button 73*b* with his/her finger.

Figure 9:
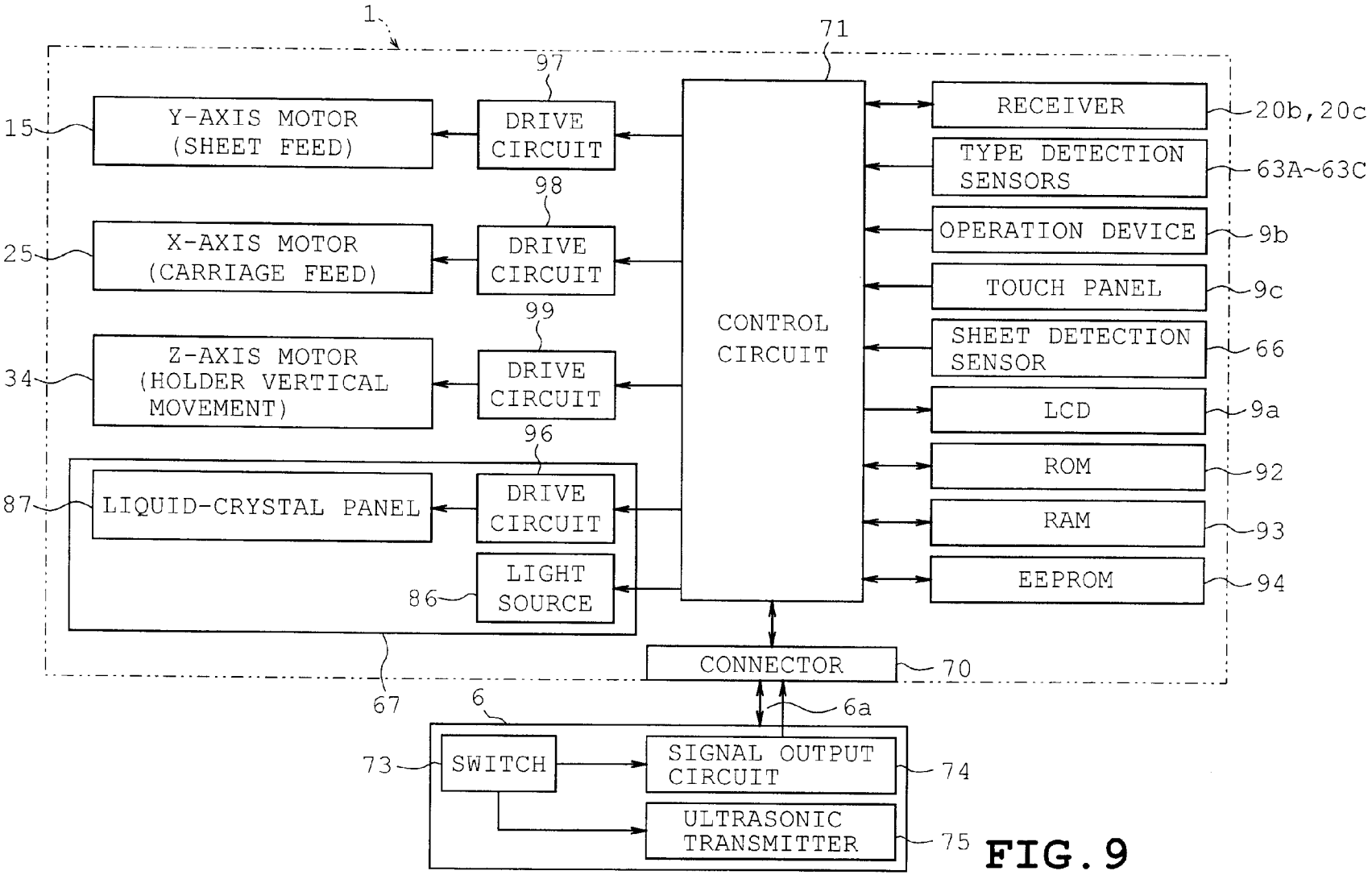
FIG. 9 is a schematic block diagram showing an electrical arrangement of the processing apparatus.

The ultrasonic pen 6 includes an ultrasonic transmitter 75, a signal output circuit 74 and a switch 73 in the pen body 72, as shown in FIG. 9. The ultrasonic transmitter 75 is disposed in proximity to the pen tip 73*a* and configured to transmit ultrasonic waves from the distal end side of the pen body 72 when actuated. The signal output circuit 74 transfer the signal via the cable 6*a* to the processing apparatus 1. The switch 73 switches output states of the signal output circuit 74 and the ultrasonic transmitter 75 according to the position of the pen tip 73*a* or an operation of the button 73*b*. More specifically, when the ultrasonic pen 6 is not used, the pen tip 73*a* is located at the projected position and the switch 73 is in the OFF state. When the switch 73 is off, the ultrasonic transmitter 75 transmits no ultrasonic waves, whereby the signal generator 74 supplies no electrical signal. However, when the user presses the pen tip 73*a* against any position on the object S, the pen tip 73*a* enters the pen body 72, whereby the switch 73 is switched to the ON state. Alternatively, when the user pushes the button 73*b* while the pen tip 73*a* is located at any position on the object S instead of pressing the pen tip 73*a*, the switch 73 is switched to the ON state in response to operation of the button 73*b*. When the switch 73 is switched to the ON state, the ultrasonic transmitter 75 transmits ultrasonic waves and simultaneously, the signal output circuit 74 transfers the signal via the cable 6*a* to the processing apparatus 1.

The ultrasonic transmitter 75 is disposed in proximity to the pen tip 73*a* side. Accordingly, the position of the pen tip 73*a* can foe regarded as a transmission source. Furthermore, the cable 6*a* serves to supply electrical power to the ultrasonic pen 6 as well as to transmit the signals from the signal output circuit 74. Consequently, the ultrasonic pen 6 need not foe provided with a battery cell with the result that the weight of the processing apparatus 1 can be reduced.

Further, handwriting does not remain on the object S even when a desired pattern or the like is drawn on the object S by the ultrasonic pen 6. However, the control circuit 71 can specify the position of the pen tip 73*a* on the object S based on receipt of the ultrasonic waves from the ultrasonic pen 6 by the receivers 20*b* and 20*c*. More specifically, the control circuit 71 can specify the pattern drawn on the object S by the ultrasonic pen 6, and the like.

The ultrasonic pen 6 may be provided with no button 73*b*. Furthermore, the ultrasonic pen 6 may include the pen tip 73*a* formed integrally with the pen body 72 and the button 73*b* may be independently provided. Further, an ink tank may be provided in the pen body 72 of the ultrasonic pen 6 so that ink is caused to seep from the pen tip 73*a*, although not shown in the drawings. In this case, the ultrasonic pen 6 has both a function of transmitting ultrasonic waves and a function of drawing a desired pattern or the like on the object S.

Figure 8A:
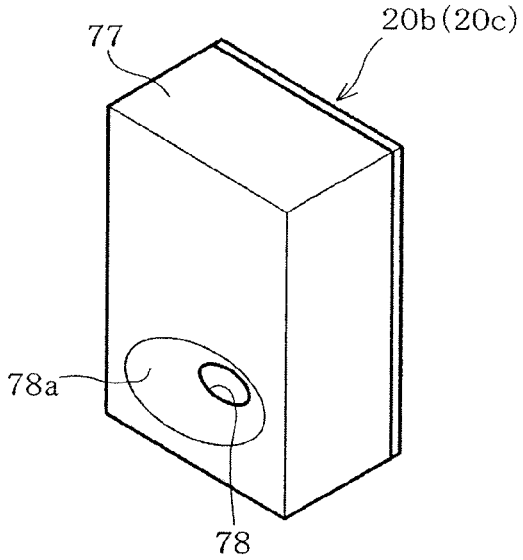
FIGS. 8, 8B and 8C are an enlarged perspective view, an enlarged front view of a receiver and a longitudinal section taken along line VIIIc-VIIIc in FIG. 8B, respectively.
Figure 8B:
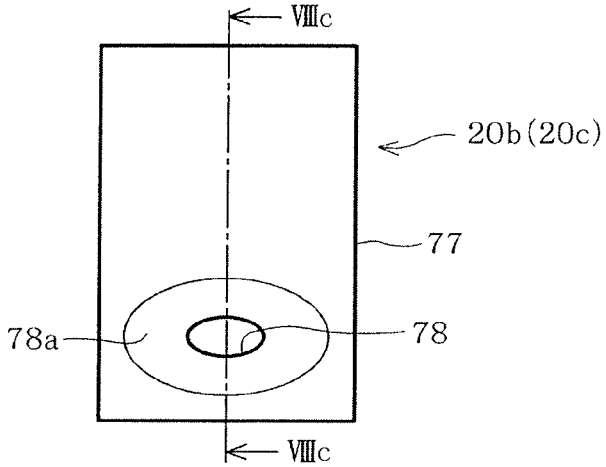
Figure 8C:
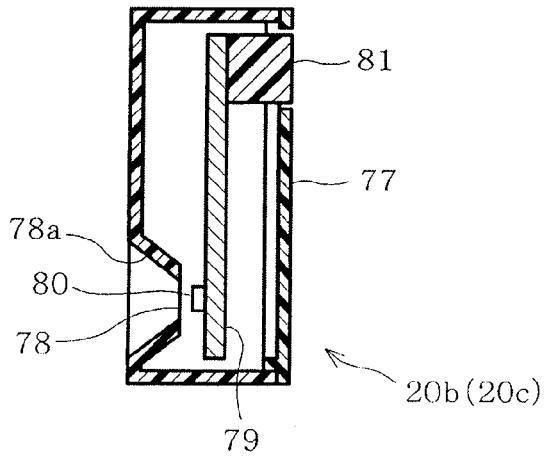

The receivers 20*b* and 20*c* serve as detection devices for detecting (receiving) ultrasonic waves transmitted from the ultrasonic pen 6. Since the paired right and left receivers 20*c* and 20*b* have the same configuration, one receiver 20*b* will be described with reference to FIGS. 8A to 8C. A case 77 constituting an outer envelope of the receiver 20*b* is formed into the shape of a vertically slightly long hollow rectangular parallelepiped. The case 77 has a lower front formed with a centrally located opening 78. The opening 78 is formed into the shape of an ellipse which is long in the right-left direction in a front view of FIG. 8B. The case 77 has an inverted tapered surface 78*a* (an inclined surface) which is located around the opening 76 and spread from the rear toward the front thereof. A substrate 79 is housed in the case 77 of the receiver 20*b* as shown in FIG. 8C. A microphone 80 is mounted on a front of the substrate 73 so as to be located at a position facing the opening 73. A connector 81 is mounted on an upper rear of the substrate 79.

The receiver 20*b* is disposed on a left end of the body cover 2 with the opening 73 being directed frontward (with the connector 81 being directed rearward). The connector 81 is connected to the control circuit 71. On the other hand, the receiver 20*c* is disposed on a right end of the body cover 2 in the same manner as the receiver 20*b*. A connector 81 of the receiver 20*c* is also connected to the control circuit 71. The receivers 20*b* and 20*c* are installed so that the microphone 80 (the opening 78) is located slightly above the object S. Thus, when the ultrasonic pen 6 transmits ultrasonic waves, the receivers 20*b* and 20*c* receive the ultrasonic waves at the front side of the body cover 2. As long as the ultrasonic waves can be received, the positions of the receivers 20*b* and 20*c* should not be limited to those described above and may be appropriately changed.

The control circuit 71 further serves as a specifying unit which specifies the aforesaid designated position on the object S, based on the ultrasonic wave detection signals by the receivers 20*b* and 20*c* and the transmission signal transmitted from the ultrasonic pen 6 via the cable 6. The designated position is specified by a world coordinate system representing a whole space and can be shown by the aforesaid X-Y coordinate system in the processing apparatus 1. The world coordinate system in the embodiment is a three-dimensional coordinate system and has, as the origin O, the left corner of the adhesive layer 10*v* of the holding sheet 10 in the same manner as the two-dimensional coordinate system of the processing apparatus 1.

Figure 7:
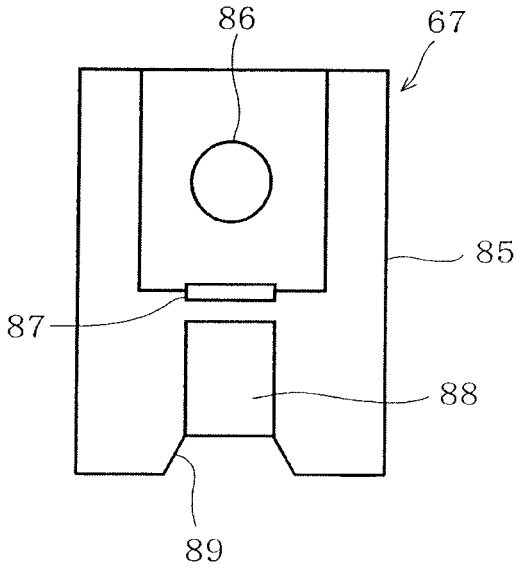
FIG. 7 is a schematic diagram of an inner structure of a projector.
Figure 13:
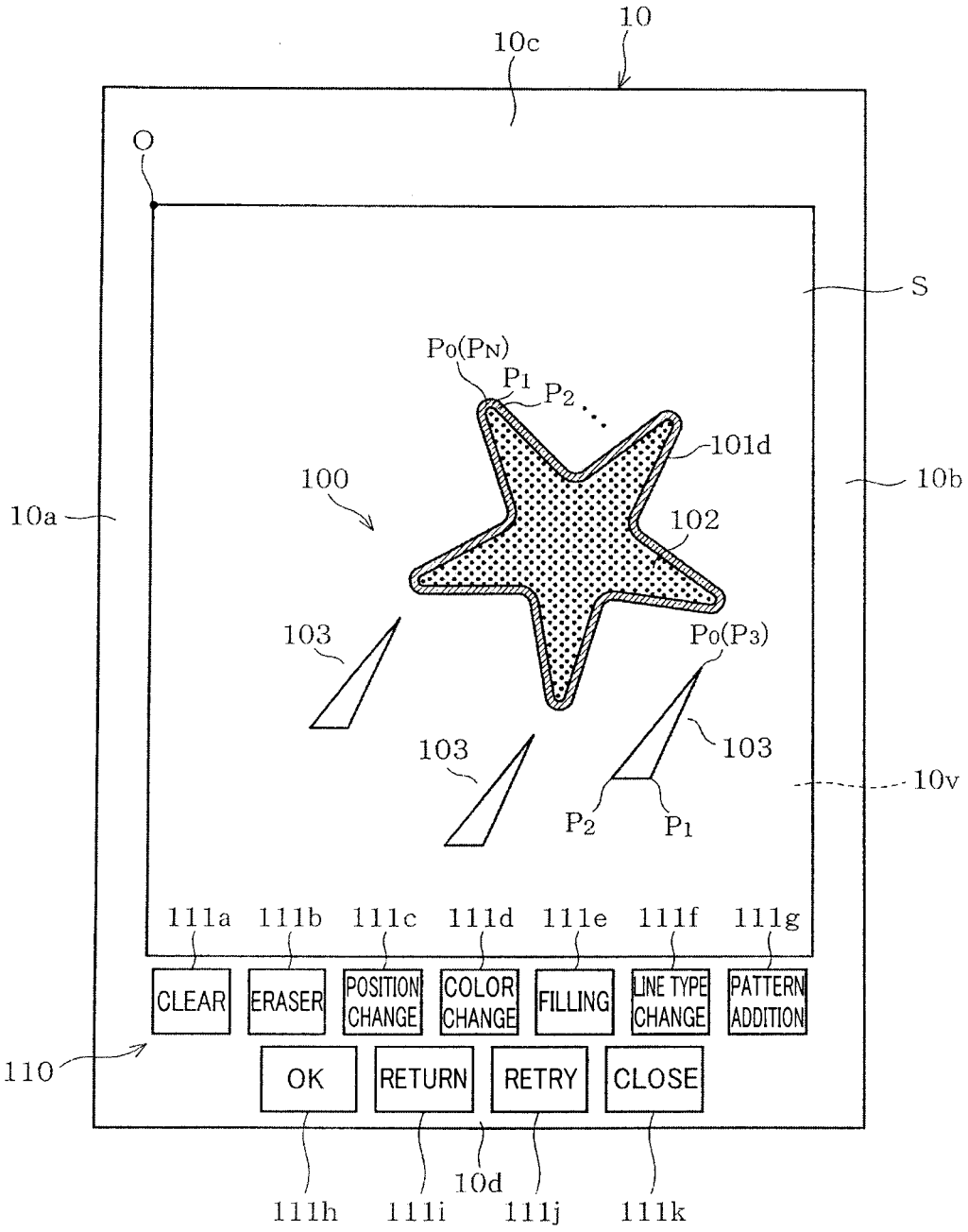
FIG. 13 is a plan view of the object held on a holding member and an image projected on the object.

The projector 67 serves as a projection device which projects an edited pattern 100 and images of icons 111*a* to 111*k* and the like as shown in FIG. 13. The projector 67 is housed in a rectangular box-shaped casing 35, for example as shown in FIGS. 1 and 7. A support member 84 is mounted on the rear of the body cover 2 so as to stand upward. The casing 85 is supported by the support member 84 so as to be located above the processing apparatus 1. Thus, the support member 84 supports the casing 85 so that the casing 85 is spaced away from the object S by a predetermined distance and so that an optical axis of projection light is oriented diagonally forward and downward toward the central part of the holding sheet 10. The projector 67 includes an adjusting unit (not shown) which adjusts a size and a focal point of ah image to be projected. As a result, the projector 67 projects an image onto a predetermined projection range Q (see FIG. 1) on the holding sheet 10 holding the object S.

More specifically, the projector 67 includes a light source 86, a liquid-crystal panel 87 and an imaging lens 88 in the casing 85, as shown in FIG. 7. The light source 86 comprises a discharge lamp such as a metal halide lamp, for example. The liquid-crystal panel 87 modulates light incident from the light source 36, forming image light to be projected. The imaging lens 38 causes the image light formed by the liquid-crystal panel 37 to be focused onto the projection range Q on the holding sheet 10 through a projection opening 89 formed in a lower part of the casing 85. The projection range Q encompasses a range in front of the origin O of the holding sheet 10, including an entire area of the object S (the adhesive layer 10*v*) and the front edge 10*d* of the holding sheet 10, as shown in FIG. 1.

In this case, a process of compensating distortion of the image is executed by the projector 57 since the image is projected onto the object S diagonally from above. Image data of the edited pattern 100 is related to the coordinate system of the processing apparatus 1 and accordingly, the coordinate position of the image data can be corrected on the basis of the aforesaid designated position. Although an image projected from the projector 67 is colored by a plurality of colors, the image may be monochromatic or may be adjusted into a color according to that of the object S.

The arrangement of the control system of the processing apparatus 1 will be described with reference to FIG. 9. The control circuit (control device) 71 controlling the whole processing apparatus 1 is mainly composed of a computer (CPU). A ROM 92, a RAM 93 and an EEPROM 94 are connected to the control circuit 71. The ROM 92 stores a cutting control program for controlling a cutting operation and a printing control program for controlling a printing operation. The ROM 92 also stores a processing program for executing a main process which will be described later, a display control program for controlling a displaying operation of the display 9*a* and the like. The EEPROM 94 stores cutting data for cutting a plurality of types of patterns, printing data for printing a plurality of types of patterns, various parameters for generating image data of a projected image, and the like.

The control circuit 71 is supplied with signals generated by the sheet detection sensor 66, the type detection sensors 63A to 63C, the receivers 20*b* and 20*c*, and the like. The signals generated by the receivers 20*b* and 20*c* are amplified by an amplifier circuit (a drive circuit not shown) of the microphone 30 mounted on the substrate 79. The control circuit 71 is connected to the display 9*a*, the touch panel 9*c* and various operation switches of the operation device 9*b*. While viewing displayed contents on the display 9*a*, the user operates the operation switches of the operation device 9*b* and the touch panel 9*c*, thereby selecting a desired pattern or setting parameters. The control circuit 71 is also connected to the light source 86 of the projector 67 and drive circuits 96 to 99 driving the liquid-crystal panel 87, the Y-axis motor 15, the X-axis motor 25 and the Z-axis motor 34 respectively. Based on cutting data or printing data, the control circuit 71 controls the Y-axis motor 15, the X-axis motor 25, the Z-axis motor 34 and the like, so that a cutting or printing operation is automatically executed for the object S on the holding sheet 10.

On the other hand, the switch 73 of the ultrasonic pen 6 is electrically connected to a signal output circuit 74 and an ultrasonic generator 75. The signal output circuit 74 is connected via the cable 6*a* and the connector 70 to the control circuit 71. Accordingly, when the switch 73 is turned on, the signal output circuit 74 transmits a signal via the cable 6*a* to the control circuit 71 side and the ultrasonic transmitter 75 simultaneously transmits ultrasonic waves.

Figure 12:
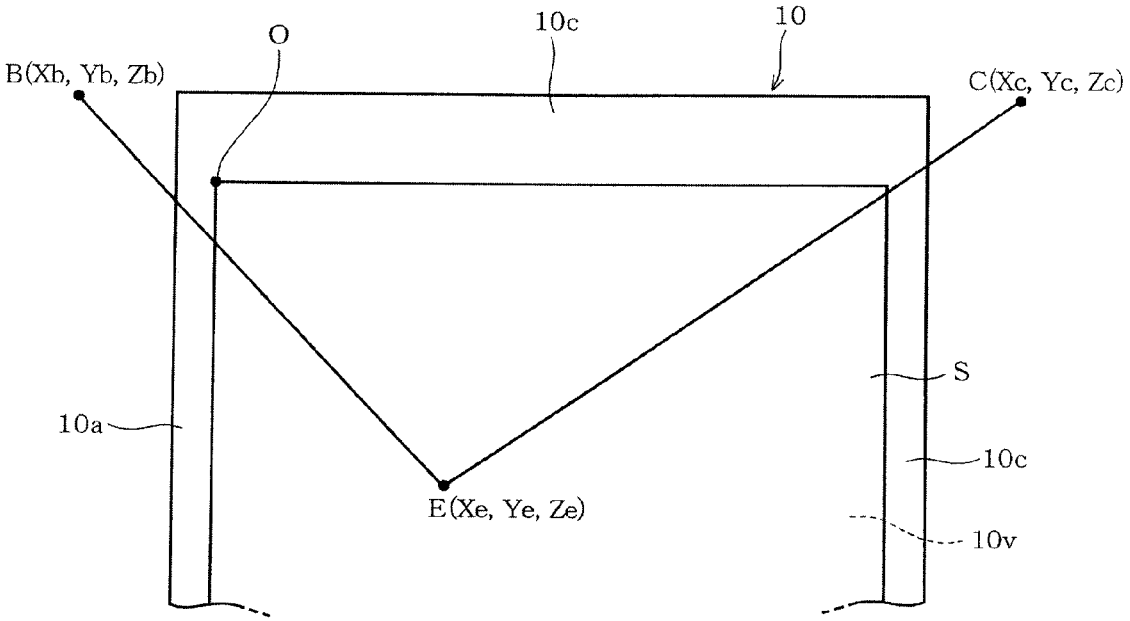
FIG. 12 illustrates the relationship between a designated position on an object to be processed and positions of receivers.

The following will describe a manner of specifying the designated position on the object S designated by the ultrasonic pen 6, with reference to FIGS. 1 and 12. The object S is set on the processing apparatus 1 while being held by the holding sheet 10. The rear corners of the holding sheet 10 are held between the rollers 13*a* of the pinch roller 13 and the driving roller 12, as shown in FIG. 1. As a result, the holding sheet 10 holding the object S is positioned at predetermined frontward position on the upper surface of the platen 3 so as to be substantially horizontal. The user presses the pen tip 73*a* of the ultrasonic pen 6 against the object S on the holding sheet 10 or operates the button 73*b* thereby to designate any position.

In this case, the designated position is assumed to be in the region of the adhesive layer 10*v* where the object S is positioned, namely, within the projection range Q including a region in which the object S (the adhesive layer 10*v*) is located and the region 10*d* located in front of the region of the object S. Further, a position of the ultrasonic transmitter 75 serving as a transmission source of ultrasonic waves is specified as the designated position. More specifically, the pen tip 73*a* and the ultrasonic transmitter 75 are disposed in proximity to each other. Accordingly, the position of the pen tip 73*a* pressed against the object S can be regarded as the designated position.

Furthermore, the designated position is specified by three-dimensional coordinate information (X coordinate, Y coordinate, Z coordinate) of the world coordinate system. The origin (0, 0, 0) of the world coordinate system is the left corner of the adhesive layer 10*v* of the holding sheet 10. The Z coordinate is 0 on the upper surface of the holding sheet 10. Assume now that coordinate S (Xe, Ye, Ze) represents the designated position as shown in FIG. 12. Also assume that coordinate B (Xb, Yb, Zb) represents the position of the left microphone 80 and that coordinate G (Xc, Yc, Zc) represents the position of the right microphone 80. The ROM 92 stores values Xb, Yb and Zb of the coordinate B of the receiver 20*b* and values Xc, Yc and Zc of the coordinate C of the receiver 20*c*. The Z coordinates Zb and Zc of the receivers 20*b* and 20*c* represent the heights of the microphones 30 with respect to the holding sheet 10 respectively.

The coordinate E will be referred to as "designated coordinate E" and a distance between the designated coordinate E and the coordinate B will be referred to as "distance EB." A distance between the designated coordinate E and the coordinate C will be referred to as "distance EC." In this case, the distances EB and EC as shown in the plan view of FIG. 12 can be represented by the values of coordinates B, C and E on the basis of the Pythagorean theorem. More specifically, the distance EB is represented by the following equation (1) using the values of the coordinates E and B and the distance EC is represented by the following equation (2) using the values of the coordinates E and C:

$$(Xb-Xe)^2+(Yb-Ye)^2+(Zb-Ze)^2=(EB)^2 \quad (1)$$

$$(Xc-Xe)^2+(Yc-Ye)^2+(Zc-Ze)^2=(EC)^2 \quad (2)$$

Equation (1) is identical with an equation of a spherical surface which has a central point represented by the coordinate B and a radius represented by the distance EB and passes the designated coordinate E. Equation (2) is similarly identical with an equation of a spherical surface which has a central point represented by the coordinate C and a radius represented by the distance EC and passes the designated coordinate E.

A transmission time Tb designates a time required from transmission of ultrasonic wares from the ultrasonic pen 6 designating the designated coordinate E to detection of the ultrasonic waves by the left receiver 20*b*. A transmission time Tc designates a time required from transmission of ultrasonic waves from the ultrasonic pen 6 designating the designated coordinate E to detection of the ultrasonic wave by the right receiver 20*c*. In this case, the distances EB and EC can be obtained by the following equations (3) and (4) with V designating the ultrasonic speed (sound speed in the measurement space):

$$EB=V\times Tb \quad (3)$$

$$EC=V\times Tc \quad (4)$$

An equation (5) is obtained when the equation (3) is substituted into the equation (1), and an equation (6) is obtained when the equation (4) is substituted into the equation (2):

$$(Xb-Xe)^2+(Yb-Ye)^2+(Zb-Ze)^2=(V\times Tb)^2 \quad (5)$$

$$(Xc-Xe)^2+(Yc-Ye)^2+(Zc-Ze)^2=(V\times Tc)^2 \quad (6)$$

The values of "Xb," "Yb" and "Zb" of coordinate B in equation (5) are known, and the values of "Xc," "Yc" and "Zc" of coordinate C in equation (6) are also known. The sound speed V is further known. The ROM 92 stores these values. The transmission times Tb and Tc are calculated from the differences between the timing of ultrasonic transmission from the ultrasonic transmitter 75 and the defection timings of ultrasonic waves by the receivers 20*b* and 20*c* respectively. The timing of ultrasonic transmission from the ultrasonic transmitter 75 will be referred to as "transmission timing T1" in the following. Furthermore, the detection timings of ultrasonic waves by the receivers 20*b* and 20*c* will be referred to as "detection timing T2*b*" and "detection timing T2*c*" respectively.

The object S is set on the platen 3 of the processing apparatus 1 while held by the holding sheet 10. Since the object S is so thin that the thickness thereof is ignorable, the Z coordinate of the upper surface of the object S can be zero (Ze=0). Thus, the transmission times Tb and Tc are obtained from the measured timings T1, T2*b* and T2*c*. Based on the obtained transmission times Tb and Tc and the known values Zb, Yb, Zb, Xc, Yc, Zc and V, simultaneous equations of equations (5) and (6) are solved with the result that the designated coordinate E (Xe, Ye, Ze (=0)) is obtained. In this case, the coordinate E is specified in consideration of the directionality of the receivers 20*b* and 20*c* (the directionality of the microphones 80).

Figure 11:
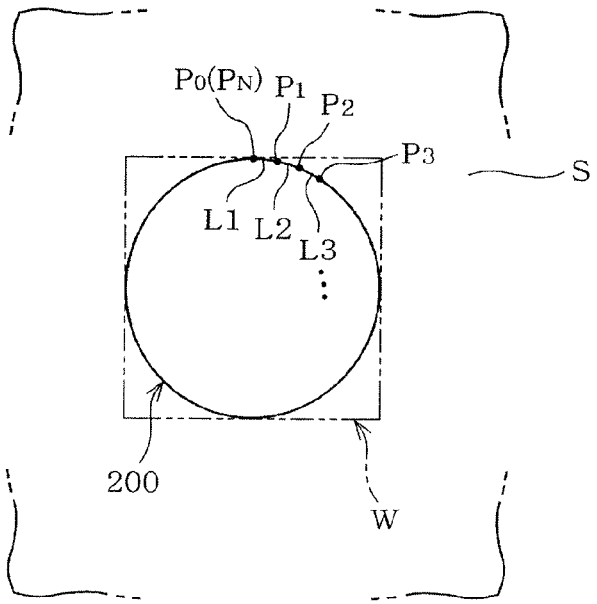
FIG. 11 illustrates an example of pattern to be cut or printed based on the processing data.

The cutting data will be described with an example in which a pattern 200 as shown in FIG. 11 is cut out of the object S held on the holding sheet 10. More specifically, the EEPROM 94 as a storage device stores cutting data of the pattern 200. The pattern 200 of "circle" is to be cut oat of the object S. Cutting data in this case includes color data, size data and cutting line data and display data as shown in FIG. 10. For example, color data represented by RGB values is associated with the display data. Accordingly, images displayed on the display 9*a* and an image projected from the projector 67 are represented as color images based on the display data of pattern 200. Further, the size data is the value indicative of the horizontal and vertical size of the pattern 200 and is represented as the size of the minimum rectangular frame W inscribed in the "circle" of pattern 200 as shown in FIG. 11, for example. The cutting line data is coordinate value data representing X-Y coordinates of apexes of a cutting line composed of a plurality of line segments and defined by the X-Y coordinate system of the processing apparatus 1.

More specifically, as shown in FIG. 11, the cutting line of pattern 200 comprises line segments L1, L2, L3, . . . connecting among a cutting start point $P_0$, apex $P_1$, apex $P_2$, . . . and cutting end point $P_N$ all on the circumference of pattern 200. The cutting line is formed into a generally circular shape as a whole by setting interapex distances at small values. Further, the cutting start line $P_0$ corresponds with the cutting end point $P_N$. The cutting line data has first coordinate data, second coordinate data, third coordinate data, . . . and (N+1)-th coordinate data corresponding to the cutting start point $P_0$, apex $P_1$, apex $P_2$, . . . and cutting end point $P_N$ respectively.

When the pattern 200 is cut by the processing apparatus 1, the cutter 44 is relatively moved to the X-Y coordinate of cutting start point $P_0$ by the transfer mechanism 7 and the head moving mechanism 8. The blade edge 46 of the cutter 44 is then caused to penetrate through the cutting start point $P_0$ part of the object S by the up-down drive mechanism 33. In this state, the blade edge 46 is relatively moved by the transfer mechanism 7 and the head moving mechanism 8 so as to connect linearly among the apex $P_1$, apex $P_2$, apex $P_3$ and cutting end point $P_4$ sequentially. Thus, the line segments L1, L2, L3 and L4 are cut sequentially continuously with the result that the cutting line of the circular pattern 200 is cut out.

The printing data will be described in the same manner as described with an exemplified case where the pattern 200 is printed on the object S. The printing data includes printing line data, color data, size data and display data. More specifically, as shown in FIG. 11, the pattern 200 is printed on the object S by the pen cartridge 4*p*, whereby the circle composed of the line segments L1 to L4 is drawn. The printing line data of pattern 200 includes line segment data corresponding to the line segments L1 to L4 respectively. The line segment data has coordinate data in which the start and end points of the line segments L1 to L4 are indicated by X-Y coordinates in the same manner as in the cutting line data. The color data represents the color type of the pen cartridge 4*p* and is set to be related with the display data. The size data represents the size of the printing region by a minimum rectangular frame W in which pattern 200 is inscribed, in the same manner as the aforesaid rectangular frame W of the cutting region.

In the printing, the pen cartridge 4*p* of the relevant type is displayed on the display 9*a* on the basis of the color data. The user attaches the pen cartridge 4*p* to the cartridge holder 32 while viewing displayed contents on the display 9*a*. The control circuit 71 executes the above-described printing operation and relatively moves the pen cartridge 4*p* based on the printing line data, whereby the line segments L1 to L4 are plotted on the object S. As a result, the pattern 200 is printed in the color of the color data. The cutting operation and the printing operation both controlled by the control circuit 71 will be collectively called "processing operation" hereinafter.

The processing data includes data of coordinate values specified by the X-Y coordinate system of the processing apparatus 1 as described above. The coordinate value data is set so as to be related to the world coordinate system. Accordingly, edit of the processing data of the selected pattern 200 or the like, such as change in the processing position, can be executed with the use of the ultrasonic pen 6 on the basis of the designated coordinate represented by the world coordinate system in the embodiment. Further, the projector 67 in the embodiment projects an editing menu image 110 onto the holding sheet 10 in the edit by the use of the ultrasonic pen 6. The editing menu image 110 includes a plurality of icons 111*a* to 111*k* which are projected onto the front edge 10*d* of the holding sheet 10, for example, as shown in FIG. 13.

The user can select contents to be edited by designating the position of any one of the icons 111*a* to 111*k* by the ultrasonic pen 6. For example, the left upper icon 111*a* is selected when an entire edit pattern is deleted. The icon 111*b* is selected when a part of the edit pattern is deleted. The icon 111*c* is selected when the position of the edit pattern, that is, the processing position on the object S are changed. The icon 111*d* is selected when the color of partial or entire line segment constituting the edit pattern is changed. The color of line segment is set using colors of a pallet 112*d* as shown at S71 in FIG. 14. The icon 111*e* is selected when a closed region encircled by the line segments of the edit pattern is filled. A color to fill the closed region is set using a pallet 121*e*, for example, as shown at S131 in FIG. 14. The icon 111*f* is selected when a line thickness is changed as a part or entire line type composing the edit pattern. The line thickness is selected from thicknesses as shown at S111 in FIG. 14, for example.

The icon 111*g* is selected when pattern data stored in a storage device such as the EEPROM 94 is added as an edit pattern. The pattern to foe added is selected from a pattern list 111*g* as shown at S131 in FIG. 14, for example. The pattern list 112*g* includes diagrams representing symbols, characters and the like as well as various figures of the above-described "circle," "triangle," "square" and the like. The icon 111*h* is selected when processing data of edit pattern is generated after completion of edit. The icon 111*i* is selected when the operation sequence is returned to the last operation. The icon 111*j* is selected when an operation sequence is returned to the last operation. The icon 111*k* is selected when the menu image 110 is closed for completion of the process. The icons 111*a* to 111*k* are projected onto the front edge 10*d* of the holding sheet 10. On the other hand, the edit pattern is projected onto the object S (a suitable region). Accordingly, the icons 111*a* to 111*k* can be prevented from interfering with designation of the processing position of the edit pattern.

In the embodiment, the edit pattern refers to a pattern the processing apparatus 1 is capable of editing based on the aforesaid designated position. The designated position is specified by the control circuit 71 serving as a specifying unit. Accordingly, for example, processing data of the edit pattern can be generated by the ultrasonic pen 6 on the basis of a plurality of continuously output designated positions (see pattern 101*d* in FIG. 13). In this case, the edit pattern includes a cutting or printing line composed of line segments connecting a plurality of specified coordinates. Further, a color of desired line segment and a color to fill the closed region can be set using the pallets 112*d* and 112*e* regarding the printing of the edit pattern or the display color data. Additionally, pattern data stored in the storage device can be selected from the pattern list 112*g*, and the size and the processing position of the selected pattern can be set (see pattern 103 in FIG. 13).

Figure 15:
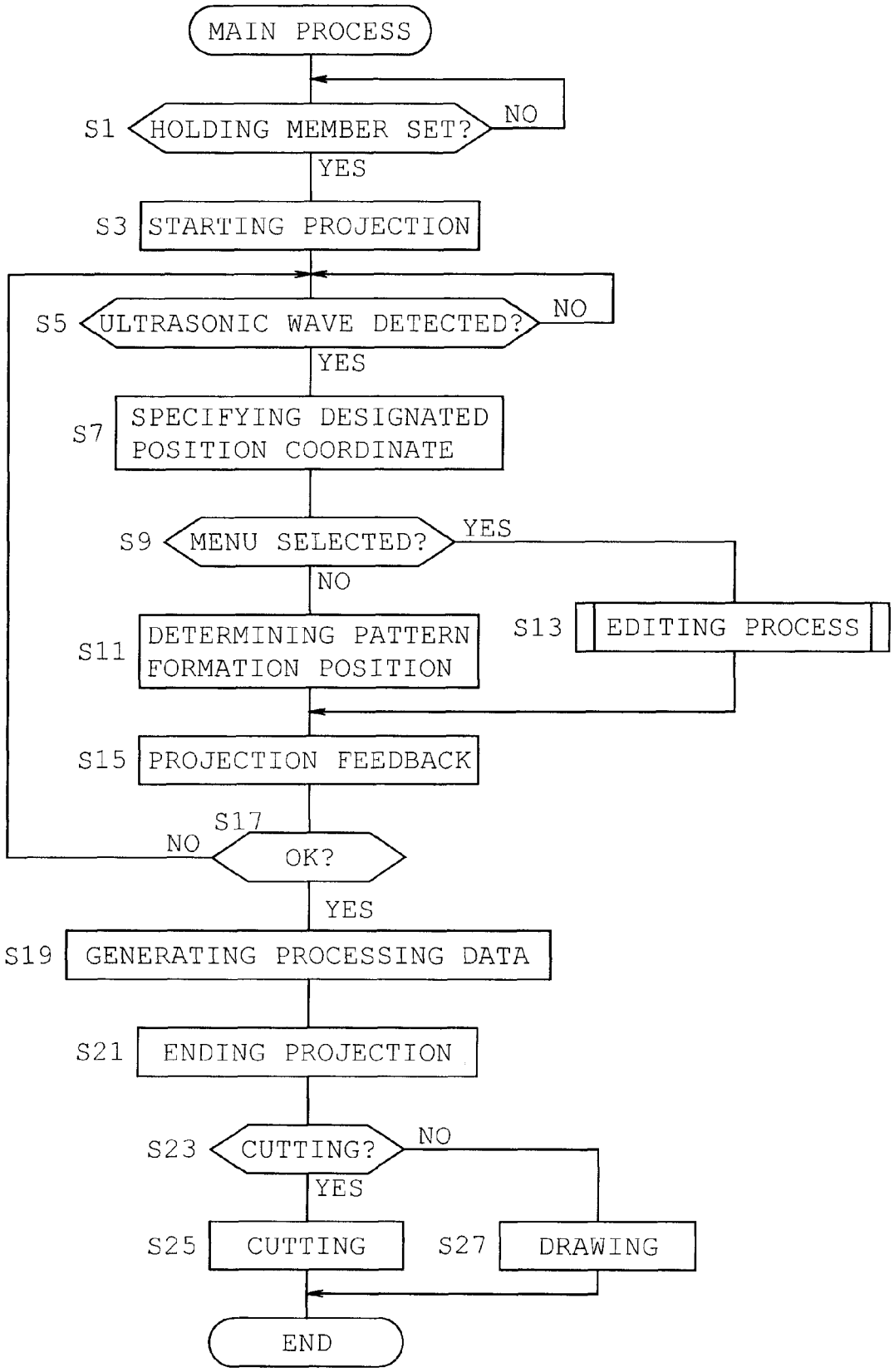
FIG. 15 is a flowchart of a main process, showing a whole processing flow.

A main process in the processing apparatus 1 will now be described with reference to FIGS. 15 to 17. Assume that the main process includes specifying a designated position using the ultrasonic pen 6, generating the processing data of the edit pattern and executing a processing operation. Further assume that the edit pattern 100 in the embodiment includes a pattern 101*d* of "star" exemplified in FIG. 13 and a pattern 103 of "triangle."

The user firstly attaches the object S such as a piece of paper to the holding sheet 10 and sets the holding sheet 10 onto the platen 3 of the processing apparatus 1. As a result, based on a detection signal from the sheet detection sensor 66, the control circuit 71 determines that the holding sheet 10 is set (YES at step S1). In this case, the control circuit 71 drives the transfer mechanism 7 to hold the rear corners of the holding sheet 10 between the rollers 13*a* of the pinch roller 13 and the driving roller 12. Thus, the object S on the holding sheet 10 is positioned so as to be substantially horizontal at a predetermined frontward position on the upper surface of the platen 3.

The control circuit 71 then actuates the drive circuit 96 and the light source 86 to cause the projector 67 to project a projection image (step S3). In this case, the image to be projected includes the menu image 110 which is to be projected so as to overlap the front end 10*d* of the holding sheet 10. On the other hand, the user presses the pen tip 73*a* of the ultrasonic pen 6 against the menu image 110 or any position on the object S thereby to designate a designated position. At this time, the signal output circuit 74 of the ultrasonic pen 6 supplies an electrical signal via the cable 6*a* in synchronization with the pressing of the pen tip 73*a* against the object S. Simultaneously, the ultrasonic transmitter 75 transmits ultrasonic waves.

Consequently, when detecting an electrical signal via the cable 6*a*, the control circuit 71 obtains the signal detection time as transmission timing T1. When further detecting the ultrasonic waves by the receivers 20*b* and 20*c* (YES at step S5), the control circuit 71 obtains the detection times as detection timings T2*b* and T2*c* respectively. Thus, the control circuit 71 obtains the transmission timing T1 and the detection timings T2*b* and T2*c* as information representing the designated position. The control circuit 71 further calculates transmission times Tb and Tc of the receivers 20*b* and 20*c* respectively from the transmission timing T1 and the defection timings T2*b* and T2*c*, respectively. The control circuit 71 then executes an operation to solve the simultaneous equations of equations (5) and (6) based on the obtained transmission times Tb and Tc and the aforesaid known values Xb to Zb, Xc to Zc and V, thereby specifying coordinate of a single designated position from the directionality of the receivers 20*b* and 20*c* (step S7).

The control circuit 71 then determines whether or not the icons 111*a* to 111*k* have been selected, based on the coordinate of the designated position specified at step S7 and image data (coordinate data) of the menu image 110 (step S9). Here, an editing process which will be described later is executed (step S13) when the designated position is on one of the icons 111*a* to 111*k* (YES at step S9). On the other hand, when a region other than the icons 111*a* to 111*k* is designated (NO at step S9), the control circuit 71 specifies the edit pattern end the processing position based on the coordinate of the designated position (step S11). More specifically, assume the case where the user moves the pen tip 73*a* of the ultrasonic pen 6 so as to draw a star while pressing the pen tip 73*a* against the object S. In this case, the ultrasonic pen 6 transmits ultrasonic waves at a predetermined interval (20 msec, for example) while the pen tip 73*a* is pressed against the object S. The control circuit 71 edits the designated portions sequentially specified according to the interval at steps S5 and S7 as a pattern 101*a* of star obtained by connecting the designated positions by line segments in the order of specifying. Accordingly, the processing position of the pattern 101*a* set at the position designated on the object S by the ultrasonic pen 6.

The control circuit 71 executes a process of reflecting the pattern 101*a* edited at step S11 on the projection image (step S15). In this case, the control circuit 71 generates image data representing the edit pattern 101*a*, that is, a locus of the pen tip 73*a* on the object S. Since known techniques are available for the generation of image data, a detailed description of the generation of image data will be eliminated.

Figure 14:
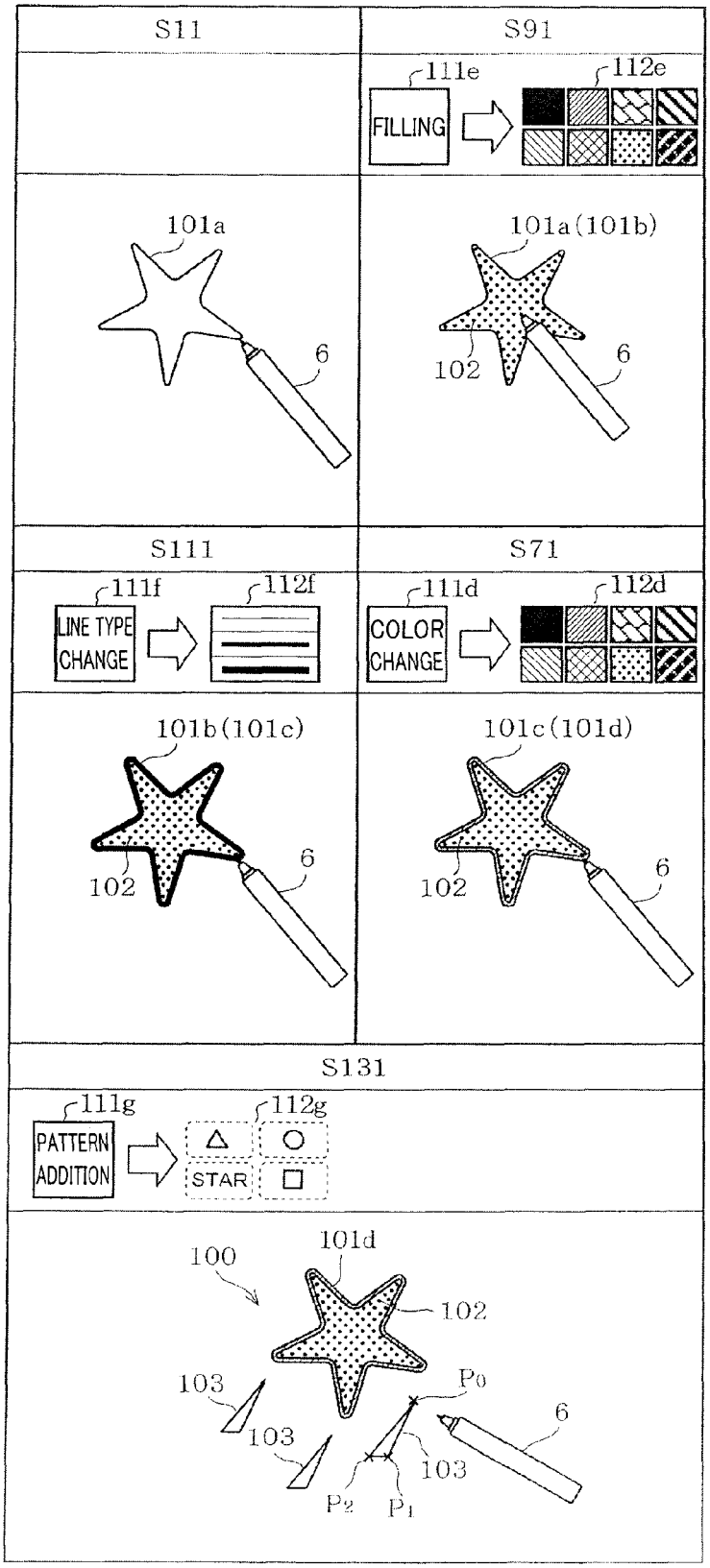
FIG. 14 illustrates a state transition diagram showing a pattern being edited together with corresponding icons.

The projector 67 projects the image representing the pattern 101*a* onto the processing position based on the image thus generated (see step S11 in FIG. 14). The user designates the "OK" icon 111*h* by the ultrasonic pen 6 when finishing the edit of the pattern 101*a* (YES at step S17). When the "CLOSE" icon 111*k* has been designated during the projection at steps S3 to S21, the main process including the projection is completed. This is not shown in FIG. 15. Further, the edit of pattern can be continuously carried out unless the "OK" and "CLOSE" icons 111*h* and 111*k* are designated (NO step S17).

Figure 16:
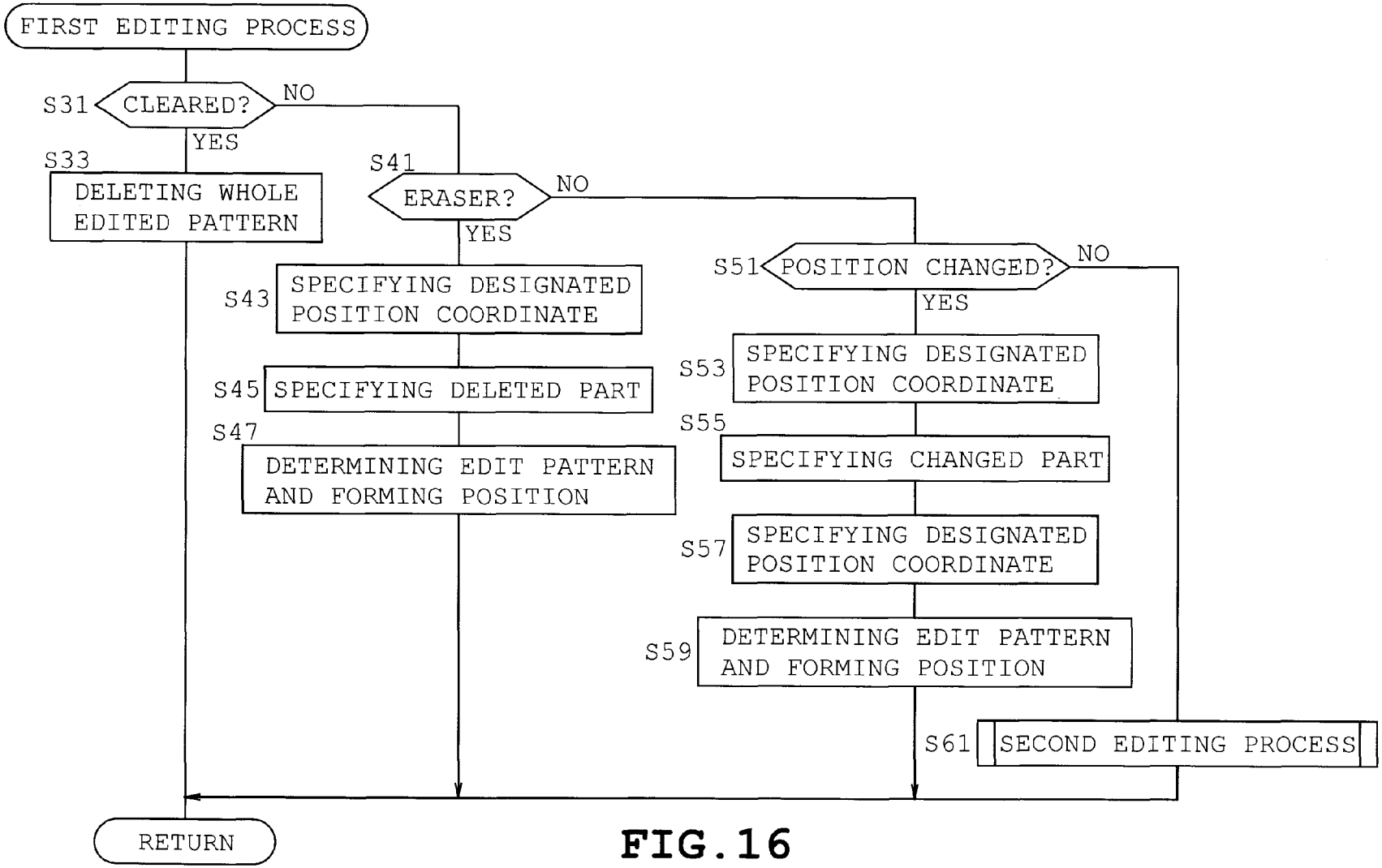
FIG. 16 is a flowchart of a first editing process.

When determining at step S9 that any one of the icons 111*a* to 111*k* has been selected (YES), the control circuit 71 proceeds to a first editing process as shown in FIG. 16 (step S13). Processing according to the contents of the designated icon is carried out in the first editing process. Accordingly, although not described in the following processing, a sequence of input by the user with the use of the ultrasonic pen 6 may be supported by voice message or projected images to support the input operation.

At steps S31, S41 and S51 in FIG. 16, the control circuit 71 determines a designated one of the icons 111*a* to 111*c*, based on the coordinate of designated position specified at step S7 and the image data (coordinate data). When the "CLEAR" icon 111*a* has been designated (YES at step S31), the control circuit 71 determines that the whole pattern should be deleted from the editing contents (step S33). As a result, entire data edited before step S33 and specifying the pattern 101*a* is deleted. Further, the pattern 101*a* is also deleted from the projected image being projected (the control circuit 71 returns to step S51).

When the "eraser" icon 111*b* has been designated (No at step 331 and YES at step S41), the control circuit 71 determines that the editing contents indicate deletion of a part of the pattern. The control circuit 71 thereafter deletes a part of the pattern 101*a* corresponding to a coordinate supplied from the ultrasonic pen 6. A manner of designating a part to be deleted may be set or designated by the user. For example, when an inner part of the rectangular range set by the user is deleted, two diagonal apexes of the rectangle are designated using the ultrasonic pen 6. Alternatively, a line segment of the pattern 101*a* projected on the object S is designated by tracing the line segment with the ultrasonic pen 6. In this case, the control circuit 71 carries out the similar calculation to that at step S7 to specify a coordinate of the designated position (step S43). A part of the pattern 101*a* inside a rectangle having as two apexes specified first and second designated positions is deleted or the pattern 101*a* is updated to a pattern from which the specified line segment has been deleted (steps S45 and S47). Additionally, the pattern 101*a* being projected is also updated to a projected image from which a corresponding part has been deleted (the control circuit 71 returns to step S15).

When the "position change" icon 111*c* has been designated (NO at steps S31 and S41 and YES at step S51), the control circuit 71 determines that the editing contents indicate change in the position of the pattern. Subsequently, the control circuit 71 executes a process of changing the position of the pattern based on a coordinate supplied from the ultrasonic pen 6. The position changing process includes a process of designating a pattern (a line segment) to be changed (step S53) and a process of designating a position where the pattern (the line segment) is to be relocated. These designating manners may be set or may be designatable by the user. For example, when a pattern (a line segment) inside the rectangular range set by the user is to be moved, two diagonal points of a rectangle are designated by the use of the ultrasonic pen 6. Alternatively, the pattern 101*a* being projected on the object S is designated by the use of the ultrasonic pen 6. In this case, the control circuit 71 carries out the similar calculation to that at step S7, specifying a coordinate of the designated position (step S53). An overall or part of the pattern 101*a* within the rectangle having two designated positions as apexes is specified as a target to be moved, or an overall designated pattern 101*a* is specified (step S55). Further, when the overall pattern 101*a* is a target to be moved, a destination position on the object S is designated by the ultrasonic pen 6 regarding the center point of the pattern 101*a* or either apex of the rectangle, each of which serves as a reference. The control circuit 71 thus executes the similar calculation to that at step S7, regarding the designated position of the destination and moves the pattern 101*a* to a specified position, thereby determining a processing position, on the object S (the control circuit 71 returns to step S15).

Figure 17:
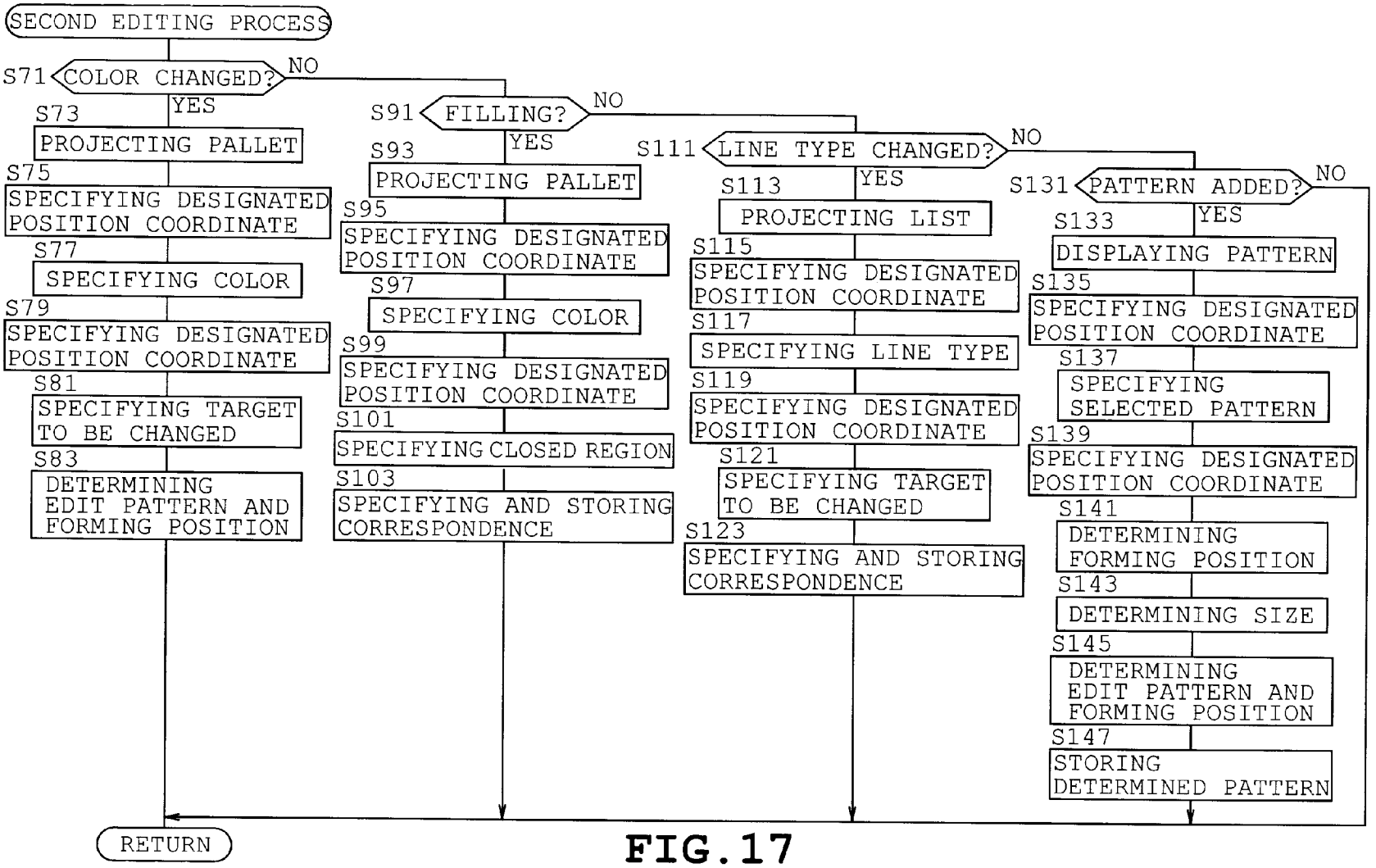
FIG. 17 is a flowchart of a second editing process.

The control circuit 71 proceeds to a second edit process (step S61) as shown in FIG. 17 when determining in the negative (NO) at each one of steps S31, S41 and S51. The control circuit 71 determines the designated icons 111*d* to 111*g* based on a coordinate of the designated position specified at step S7 and image data (coordinate data) of the menu image 110 at steps S71, S91, S111 and S131.

When the icon 111*e* of "filling" has been designated (No at step S7 and YES at step S91), the control circuit 71 determines that the editing contents indicate a color of the closed region encompassed by the line segments of the pattern. In this case, the control circuit 71 projects a pallet 112*e* as shown at S91 in FIG. 13 onto a part near the projected icon 111*e* (step S93). The pallet 111*e* includes icons representing a plurality of colors. A color of the closed region 102 encircled by the line segments of the pattern 101*a* is selectable from the colors in the pallet 111*e* in the embodiment. The colors of the pallet 111*e* may be set or may be registered by the user in consideration of usable colors or the like. The user then presses the pen tip 73*a* against a desirable one of the colors of the pallet 112*e* thereby to designate the color. The control circuit 71 executes the similar calculation to that at step S7 to specify a coordinate of the designated position (step S95). The control circuit 71 then specifies the designated color based on the specified coordinate of the designated position and the image data (coordinate data) of the icon of the pallet 112*e* (step S97).

Further, the user presses the pen tip 73*a* against any position within the closed region 102 of the pattern 101*a* projected on the object S. The control circuit 71 executes the similar calculation, to that at step S7 to specify the coordinate of the designated position (step S99) and also the closed region 102 encompassing the specified coordinate (step S101). The control circuit 71 then stores data or the specified closed region 102 and the designated color in the RAM 93 while the specified closed region 102 and the designated color are correlated with each other (step S103). The color in which the closed region 102 is printed or which is displayed is thus set, and the pattern 101*a* being projected is updated to a pattern 101*b* having a closed region 102 filled with the color (the control circuit 71 returns to step S15).

When the icon of "line type change" has been designated (NO at steps S71 and S91 and YES at step S111), the control circuit 71 determines that the editing contents indicate a change in the line thickness. In this case, the control circuit 71 projects a line type list 112*f* as shown at S111 in FIG. 14 onto a part near the projected icon 111*f* (step S113). The line type list 112*f* includes icons representing a plurality of line segments having different line thicknesses. A line thickness of the pattern 101*b* is selectable from the line thicknesses in the pallet 112*e* in the embodiment. The line thicknesses and the types of the pen cartridges 4*p* are correlated with each other in a look-up table stored in the EEPROM 94 in the embodiment. More specifically, a plurality of types of pen cartridges 4*p* prepared has different thicknesses of pen tips 48, and the type of the cartridge 4*p* corresponding to one of the line segments of the line type list 112*f* can be specified.

The user then presses the pen tip 73*a* against a desirable one of the line segments of the pallet 112*f* thereby to designate the line type. The control circuit 71 executes the similar calculation to that at step S7 to specify a coordinate of the designated position (step S115). The control circuit 71 then specifies the designated line thickness based on the specified coordinate of the designated position and the image data (coordinate data) of the icon of the pallet 112*f* (step S117). The user then presses the pen tip 73*a* against the line segment of the pattern 101*b* projected on the object S thereby to designate the line segment. The control circuit 71 executes the similar calculation to that at step S7 to specify the designated line segment based on a coordinate of the specified designated position (steps S119 and S121). The control circuit 71 stores data of the specified line segment and the designated line thickness in the RAM 93 while the specified line segment and the designated line thickness are correlated with each other (step S123). The control circuit 71 thus sets the line thickness of the line segment of the pattern 101*b* to be printed or displayed and updates the projected pattern 101*b* to a pattern 101*c* with the changed line thickness (the control circuit 71 returns to step S15).

When the icon 111*d* of "color change" has been designated (YES at step S71), the control circuit 71 determines that the editing content indicates a color of the line segment of the pattern. In this case, the control circuit 71 projects a pallet 112*d* as shown at S71 of FIG. 14 onto a part near the projected icon 111*d* (step S73). The pallet 112*d* includes icons representing a plurality of colors in the same manner as the pallet 112*e*, for example. A color of the line segment of the pattern 101*c* is selectable from a plurality of colors in the pallet 112*d* in the embodiment. The colors of the pallet 112*d* may be set or registered by the user in consideration of usable colors or the like. The user then presses the pen tip 73*a* against a desirable one of the colors of the pallet 112*d* thereby to designate the color. The control circuit 71 executes the similar calculation to that at step S7 to specify a coordinate of the designated position (step S75). The control circuit 71 then specifies the designated color based on the specified coordinate of the designated position and the image data (coordinate data) of the icon of the pallet 112*d* (step S77).

Further, the user presses the pen tip 73*a* against the line segment of the pattern 101*a* projected on the object S. The control circuit 71 executes the similar calculation to that at step S7 to specify the designated line segment based on the specified coordinate of the designated position (steps S79 and S81). The control circuit 71 then stores data of the specified line segment and the designated, color in the RAM 93 while the specified line segment and the designated color are correlated with each other (step S83). As a result, the color in which the line segment of the pattern 101*c* is printed or displayed is set, and the pattern 101*c* being projected is updated to a pattern 101*d* having the line segment whose color has been changed (the control circuit 71 returns to step S15).

When the icon 111*g* of "pattern addition" has been designated (NO at steps S71 and S111 and YES at step S131), the control circuit 71 determines that the editing content indicates pattern addition. In this case, the control circuit 71 projects a pattern list 112*g* as shown at S131 of FIG. 14 onto a part near the projected icon 111*g* (step S133). The pattern list 112*g* includes icons representing a plurality of patterns stored in the storage device. The pattern list 112*g* includes the patterns of "circle," "triangle" and "square" and characters. The number of patterns, layout and types of patterns may be changed appropriately, and patterns classified into various categories may be projected by category.

The user then presses the pen tip 73*a* against a desirable one of the patterns of the pattern list 112*g* thereby to designate the pattern to be combined with the pattern 101*d*. The control circuit 71 executes the similar calculation to that at step S7 to specify a coordinate of the designated position (step S135). The control circuit 71 then specifies the designated pattern based on the specified coordinate of the designated position and the image data (coordinate data) of the icon of the pallet 112*g* (step S137). Assume now that a pattern 103 of "triangle" as shown in FIG. 14 has been selected. In a manner of arranging the selected pattern 103, two diagonal points are designated on a rectangular frame in which the pattern 103 is inscribed (see the rectangular frame W in FIG. 11). Alternatively, apexes $P_0$ to $P_2$ of the pattern 103 are designated by the ultrasonic pen 6 (step S139) as shown in FIG. 14.

In this case, the control circuit 71 executes the similar calculation to that at step S7 to specify a coordinate of the designated position. The control circuit 71 specifies a size, configuration and processing position of the pattern 103 (steps S141, S143 and S145). The specified pattern 103 is combined with the pattern 101*d* into an edit pattern, data of which is stored in the RAM 93 (step 147). The added pattern 103 is projected together with the pattern 101*d* being projected (the control circuit 71 returns to step S15). Subsequently, the "pattern addition" icon 111*g* is further designated (NO at step S17 and YES at steps S5 and S9), and steps S131 to S147 are executed repeatedly. As a result, an edit pattern 100 in which three patterns 103 are attached to a pattern of "star" 101*d* can be generated (see FIG. 13), and the editing contents are instantly fed back to the projected image (the control circuit 71 returns to step S15 in FIG. 15).

Upon designation of the "OK" icon 111*h* (NO at steps S31, S41, S51, S71, S91, S111 and S131), processing data of the edit pattern 100 being projected (YES at steps S15 and S17) is generated (step S19). More specifically, the control circuit 71 executes a known imaging process based on image data to be projected, thereby generating data of outlines of the patterns 101*d* and 103 contained in the edit pattern 100. In this case, an outline of the pattern 101*d* as shown in FIG. 13 is composed of a line segment to which are set a cutting start point $P_0$ and a cutting end point $P_N$, and coordinate values of apexes P1 and the like are calculated by dividing the outline at predetermined intervals. As a result, cutting line data of a "star" is generated (see FIG. 10). The cutting line data includes first coordinate data, second coordinate data, third coordinate data, . . . and an (N+1)-th coordinate data corresponding to the cutting start point $P_0$, apex point $P_1$, apex $P_2$, apex $P_3$ and so on. Further, data of coordinate values of apex $P_0$, apex $P_1$, apex $P_2$ and apex $P_3$ are extracted from line segments composing the pattern 103 as shown in FIG 13. As a result, data of cutting line of a "triangle" is generated. The data has first coordinate data, second coordinate data third coordinate data and fourth coordinate data corresponding to a cutting start point $P_0$, apex $P_1$, apex $P_2$ and cutting end point $P_3$ respectively.

Cutting data (full data) of the edit pattern 100 includes delimiter data added to an end of the cutting line data of each one of patterns 101*d* and 103. Further, the color data and the site data are added to the cutting line data of each one of the patterns 101*d* and 103, and the display data is also added to the cutting line data of each one of the patterns 101*d* and 103, whereby cutting data of the edit pattern 100 is generated. The color data of the cutting data may be display data representing the color of the closed region 102.

Further, the control circuit 71 also generates coordinate data representing X-Y coordinates of apexes of the extracted line segment regarding printing line data of the patterns 101*d* and 103. Since the printing line data is generated on the basis of the data that is the same as the cutting line data, coordinate data corresponding to both printing process and cutting process is generated on the basis of the coordinate values of apexes of the patterns 101*d* and 103 respectively. Delimiter data is added to an end of the printing line data of the printing data of the edit pattern 100. Further, color data, size data and displaying data are added to printing line data of each one of the patterns 101*d* and 103, whereby the printing data of the edit pattern 100 is generated. Color data of the printing data may be set together with data of each line thickness for every pattern 101*d* and every pattern 103, so that a type of the pen cartridge 4*p* is specified. Additionally, coordinate data used to fill the closed region 102 with a designated, color by the pen cartridge 4*p* may be generated as well as the printing data used to print the outlines of the patterns 101*d* and 103.

The control circuit 71 sets a processing order in the processing data so that three patterns 103 are continuously processed in order that the number of times of replacement of cartridges may be reduced as small as possible. The projection of edit pattern 100 by the projector 67 is completed after generation of the processing data (step S21). At step S23, the control circuit 71 instructs to start processing of edit pattern 100 in relation to the object S. In this case, the user causes the display 9*a* to display the processing start screen to touch the cutting start key thereon (YES at step S23). In this case, when determining that the cutter cartridge 4*c* has been attached, based on the detection signals of the type detection sensors 63A to 63C, the control circuit 71 causes the processing apparatus 1 to execute a cutting operation based on the cutting data of the edit pattern 100.

As a result, a cutting operation of cutting the patterns 101*d* and 103 in turn is carried out regarding the edit pattern 100 projected immediately before cutting (step S25). More specifically, the cutter is relatively moved to the X-Y coordinate of the cutting start point $P_0$ of the pattern 101*d* by the transfer mechanism 7 and the head moving mechanism 8. Next, the up-down drive mechanism 33 causes the blade edge 46 of the cutter 44 to penetrate through the object S at the cutting start point $P_0$, and the blade edge 46 is relatively moved by the transfer mechanism 7 and the head moving mechanism 8 so as to sequentially connect the apexes P1, P2, . . . by linear lines. The pattern of "star" is thus cut out of the object S by relatively moving the blade edge 46 along the line segments of the pattern 101*d*. The other three patterns 103 of "triangle" are also cut out of the object S based on the respective cutting line data in the same manner as described above. Further, the up-down drive mechanism 33 causes the blade edge 46 to depart from the object S. The main process is completed when all the edit patterns 100 have been out.

On the other hand, when the "printing start" key (not shown) is touched on the processing start screen (NO at step S23), the control circuit 71 determines whether or not the pen cartridge 4*p* has been attached, based on the detection signals of the type detection sensors 63A to 63C. when determining that the pen cartridge 4*p* has been attached, the control circuit 71 executes a printing operation of printing the pattern 101*d* in designated colors. When determining that the drawing of the pattern 101*d* has been completed, based on delimiter data, the control circuit 71 instructs the up-down drive mechanism 33 to cause the pen tip 43 to depart from the object S and further instructs the display 9*a* to display the type of the pen cartridge 4*p*, based on the color data of the pattern 103. The user attaches the pen cartridge 4*p* to the cartridge holder 32 while viewing the displayed contents on the display 9*a*. The control circuit 71 executes a printing operation, sequentially drawing three patterns 103 (step S27). As a result, the control circuit 71 completes the main process (END) when all the patterns 103 have been printed.

The receivers 20*b* and 20*c* serve as detection devices for detecting ultrasonic waves. The control circuit 71 executing the specifying steps S7, S43, S53, S57, S75, S73, S115, S119, S135 and S139 functions as a specifying unit which specifies a designated position on the object S. The control circuit 71 executing step S19 as the data generating step functions as a processing data generation unit.

Further, the control circuit 71 may be configured as a determining unit which determines either the edit pattern to be applied to the object S or the processing position. For example, the control circuit 71 may determine only a configuration of the edit pattern (pattern 101*a*) at step S11 based on the coordinates of a plurality of designated positions, and may determine the processing positions at steps S57 and S59.

As described above, the processing apparatus 1 of the embodiment is configured to execute a data generating step of generating processing data to apply processing to the object S based on the edit pattern and/or the processing position both determined by the determining unit and an operation control step (S25 and S27) of controlling a processing operation in which the object S and the processing head 5 are moved relative to each other based on the processing data and the object S is processed, whereby the edit pattern determined on the basis of the designated position is cut out of the object S and/or printed at the processing position on the object S determined on the basis of the designated position.

According to the above-described processing apparatus 1, a position on the object S is directly designated by an ultrasonic transmitter such as the ultrasonic pen 6. Further, a source of transmitted ultrasonic waves is specified as a designated position. The edit pattern and/or the processing position is determined on the basis of the specified designated position, whereby the processing data is generated. Consequently, the pattern can be edited on the object S easily and accurately, so that an accurate processing based on the designated position can be applied to the object S.

The object S is set on the processing apparatus 1 while being held by the holding sheet 10 serving as the holding member. The specifying unit specifies the designated position while the holding sheet 10 holding the object S is positioned at the predetermined position. According to this configuration, the designated position on the object S can be detected and specified more accurately using the holding sheet 10.

The edit pattern and the processing position of the edit pattern on the object S are determined by the determining unit. A projecting device is provided for projecting the edit pattern determined by the determining unit, onto the processing position on the object S. According to this configuration, an image of the edit pattern determined by the determining unit is projected onto the processing position on the object S. Accordingly, the edit pattern projected on the object S can bring a direct understanding of an accurate processing position on the object S. The projecting device comprises the control circuit 71 executing the projection steps S3 and S15 and the projector 67.

A modification unit is provided for modifying or deleting at least a part of the edit pattern, based on a plurality of designated positions specified by the specifying unit. According to this configuration, the convenience in editing the edit pattern can be improved as compared with the case where a part of the edit pattern cannot foe modified or deleted, whereby the usability of the processing apparatus 1 can be improved. The modification unit is composed of the control circuit 71 executing modifying steps S33, S47 and S59.

When at least a part of the edit pattern has been modified or deleted, the projecting device projects the edit pattern reflecting the modification or deletion, onto the processing position. According to this configuration, since the projected edit pattern reflects the contents of modification or deletion, the contents of modification or deletion can be confirmed on the object S with the result that a working efficiency in the edit can be improved.

The control circuit 71 executing step S137 and the ultrasonic pen 6 and the receivers 20*b* and 20*c* serve as a processed data selecting unit (data selecting device). When processed data is selected by the processed data selecting unit, the determining unit determines an edit pattern including a pattern of the selected processing data and a processing position, based on the selected processing data and a plurality of designated positions specified by the specifying unit. The processing data generating unit generates processing data on which the edit pattern including the pattern of selected processing data is applied to the processing position, based on the selected processing data and the contents determined by the determining unit.

According to the above-described configuration, the user designates a position on the object S by the ultrasonic transmitting unit thereby to instruct to determine the edit pattern including the pattern of selected processing data and the processing position. Consequently, a pattern, which is complicated so that a configuration thereof cannot be designated using the ultrasonic pen 6, or the like, can be easily edited using the stored processing data, whereby the usability of the processing apparatus 1 can be further improved.

The processing head 5 includes the cutting unit which cuts the configuration of edit pattern out of the object S. As a result, the edit pattern can be cut out of the object S based on the generated processing data.

The processing head 5 includes the printing unit which prints the edit pattern on the object S. As a result, the edit pattern can be printed on the object S based on the generated processing data.

The processing apparatus 1 should not be limited to the above-described embodiment and may be modified or expanded. For example, the following modified forms (A) to (F) may be employed.

(A) The construction and configuration of the processing apparatus 1 may be changed appropriately. The processing apparatus should not be limited to the cutting plotter but may be a cutting device having a main cutting function or a printing device having a main printing function. Further, the processing apparatus has only to be configured to perform processing on the object S by relatively moving the object S and the processing head 5. A relative movement unit should not be limited to the transfer mechanism 7 and the head moving mechanism 3.

Each, of the pallets 112*d* and 113*c* may be composed of a plurality of colors corresponding to types of colors of the pen cartridge 4*p* to be printed. The object S has only to be cuttable and printable and may be cloth or resin sheet. Equipment to detect the designated position (the detection device) may be assembled integrally with the processing apparatus 1 in the same manner as the receivers 20*b* and 20*c* or may be independent of the processing apparatus 1.

(B) The editing function of the processing apparatus 1 is switchable by designating the icons 111*a* to 111*k* to be projected onto the holding sheet 10 (the object S) by the ultrasonic pen 6 in consideration of convenience for the users. Instructions to switch the editing function and to specify a target to be edited and the contents to be edited may be entered by another manner such as the touch operation on the touch panel 9*c*. In other words, partial or entire processing of the first and second editing processes may be executed on the basis of the instructions entered by another manner such as the touch operation. Appropriate addition, elimination and changes may be carried out in types and the number of editing functions and a manner of editing an edit pattern. For example, a known figure editing function may be provided and may include rotation, enlargement and reduction of a pattern, movement of a fixed point, and the like.

(C) Data formation and generation method of processing data may be appropriately changed. For example, when an edit pattern is colored in a single color, the printing data need not include color data, and color data may be included in the cutting data irrespective of the setting of colors of a pattern. Processing data generated in the processing apparatus may be stored in an internal storage device incorporated in the processing apparatus 1 or an external storage device connected to the processing apparatus 1. In this case, the processing apparatus 1 may register, in the pattern list 112*g*, the edit pattern stored in the storage device, as a selectable pattern in a next or succeeding main process (see steps S133 to S137). Consequently, the user can use the edit pattern in the next or succeeding process with the result that the usability of the processing apparatus 1 can be improved.

(D) The projecting device should not be limited to the projector 67 but may be changed appropriately. For example, the projecting device may be detachably attachable to the processing apparatus 1. Further, the projecting device may be independent of the processing apparatus 1. The projecting device may be further configured so that a mounting position thereof is changeable. A projection range of the projecting device may be changed appropriately and has only to include the processable region (the adhesive layer 10*v*) or the object S. In the embodiment, the projector 67 reflects the edited contents in an image being projected every time an editing process is executed. However, the projector 67 should not be limited to this configuration. For example, the processing apparatus 1 may reflect the edited contents only when the user instructs the processing apparatus 1 to reflect the edited contents. The processing apparatus 1 may terminate the projection by the projector 67 when the instruction to start processing has been entered. When the projector 67 projects the menu onto the object S, a projecting position and the design of the menu image 110 may be changed appropriately.

Further, the ultrasonic pen S may be constructed so that the pen body 72 thereof incorporates an ink tank and so that ink seeps from the pen tip 73*a*, as described above. In this case, since a desired pattern or the like can be directly drawn on the object S, the construction of the processing apparatus 1 can be rendered simpler with elimination of the projector 67. Further, there is sometimes a case where handwriting left on the object S causes some trouble. In this case, an erasable ink or a spontaneously disappearing ink with lapse of time can be used.

(E) A data processing program including instructions to execute the main process, the first editing process and the second editing process is desirably stored in the aforesaid storage device until the data processing program is executed in the processing apparatus 1. Accordingly, a manner of obtaining the data processing program and the processing program may be changeable appropriately. A route through which the data processing program and the processing program are obtained may also be changeable appropriately. The storage device storing the data processing program and the processing program may be further changeable appropriately. The data processing program and the processing data may be received via a cable from another device or may be stored in the aforesaid external storage device or the internal storage device. The above-mentioned another device may include a server which is connected via a personal computer and a network to the processing apparatus 1.

(F) The steps of the main process and the first and second editing processes are executed by the control circuit 71 in the foregoing embodiment. However, a part or all of the steps may be executed by another electronic device (ASIC, for example). Further, the steps of the above-described processes may be processed by a plurality of electronic devices (a plurality of CPUs, for example) in a distributed processing manner. The steps of each one of the processes can be changed in an execution sequence if necessary. One or more of the steps of each one of the processes can be eliminated if necessary. One or more steps can be added to the steps of each one of the processes if necessary. Additionally, the functions described in the foregoing embodiment may be realized by a part or all of the processes which an operating system (OS) in operation on the processing apparatus 1 executes based on instructions from the control circuit 71.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

We claim:

1. An apparatus performing cutting or printing on an object, comprising:

a moving device configured to move a holding member and a cutting head or a printing head relative to each other, the holding member being set to the apparatus while holding the object;

a detection device configured to detect ultrasonic waves;

a projection device configured to be capable of projecting information about a pattern onto a predetermined projection range; and a control device configured to cause the apparatus to:

specify, as a designated position, a position of an ultrasonic source located within the projection range on the holding member, based on the detected ultrasonic waves with the holding member being positioned, the projection range including a holding region holding the object on the holding member and an edge region located outside the holding region on the holding member;

determine an edit pattern which is a pattern to be applied to the object, based on the designated position to be specified;

determine a cutting position or a printing position on the object based on the designated position to be specified;

cause the projection device to project the edit pattern onto a corresponding position on the holding region and a menu image onto the edge region, the corresponding position serving as the cutting position or the printing position of the edit pattern, the information about the pattern including the determined edit pattern and the menu image representing a plurality of items to edit the edit pattern;

edit the edit pattern according to editing contents represented by an applicable one of items in the menu image projected onto the edge region when a position corresponding to the applicable item has been specified, based on the position which has been specified as the designated position and which is on the edge region within the projection range;

generate data to perform cutting or printing on the object based on the determined edit pattern or the edited edit pattern and the cutting or the printing position; and control the moving device based on the generated data to move the holding member and the cutting head or the printing head relative to each other, thereby performing cutting or printing on the object.

2. The apparatus according to claim 1, wherein the control device further causes the apparatus to modify or delete at least a part of the edit pattern based on at least a plurality of specified designated positions.

3. The apparatus according to claim 2, wherein the control device further causes the apparatus to cause the projection device to project the edit pattern reflecting modification or deletion onto the cutting or printing position when at least a part of the edit pattern has been modified or deleted.

4. The apparatus according to claim 1, further comprising:

a storage device configured to store data of a plurality of patterns;

a data selecting device configured to be capable of selecting data of a predetermined one of the patterns stored in the storage device, wherein the control device further causes the apparatus to:

determine the edit pattern including the selected pattern and the cutting or printing position, based on the selected data and the specified designated positions; and generate data which applies the edit pattern including the pattern of the selected data to the cutting or printing position, based on the selected data and the determined contents.

5. The apparatus according to claim 1, wherein the control device further causes the apparatus to specify the designated position while the holding member holding the object is positioned at the predetermined position.

6. A non-transitory computer-readable medium storing a program for an apparatus comprising:

a moving device configured to move a holding member and a cutting head or a printing head relative to each other, the holding member being set to the apparatus while holding the object;

a detection device configured to detect ultrasonic waves;

a projection device configured to be capable of projecting information about a pattern onto a predetermined projection range; and a control device, wherein the program causes the control device to execute instructions which, when executed, cause the apparatus to:

specify, as a designated position, a position of an ultrasonic source located within the projection range on the holding member, based on the detected ultrasonic waves with the holding member being positioned, the projection range including a holding region holding the object on the holding member and an edge region located outside the holding region on the holding member;

determine an edit pattern which is a pattern to be applied to the object, based on the designated position to be specified;

determine a cutting position or a printing position on the object based on the designated position to be specified;

cause the projection device to project the edit pattern onto a corresponding position on the holding region and a menu image onto the edge region, the corresponding position serving as the cutting position or the printing position of the edit pattern, the information about the pattern including the determined edit pattern and the menu image representing a plurality of items to edit the edit pattern;

edit the edit pattern according to editing contents represented by an applicable one of items in the menu image projected onto the edge region when a position corresponding to the applicable item has been specified, based on the position which has been specified as the designated position and which is on the edge region within the projection range;

generate data to perform cutting or printing on the object based on the determined edit pattern or the edited edit pattern and the cutting or the printing position; and control the moving device based on the generated data to move the holding member and the cutting head or the printing head relative to each other, thereby performing cutting or printing on the object.

7. The medium according to claim 6, wherein the instructions, when executed by the control device, further cause the apparatus to modify or delete at least a part of the edit pattern based on at least a plurality of specified designated positions.

8. The medium according to claim 7, wherein the instructions, when executed by the control device, further cause the apparatus to cause the projection device to project the edit pattern reflecting modification or deletion onto the cutting or printing position when at least a part of the edit pattern has been modified or deleted.

9. The medium according to claim 6, wherein the apparatus further comprises:

a storage device configured to store data of a plurality of patterns;

a data selecting device configured to be capable of selecting data of a predetermined one of the patterns stored in the storage device, wherein the instructions, when executed by the control device, further cause the apparatus to:

determine the edit pattern including the selected pattern and the cutting or printing position, based on the selected data and the specified designated positions; and generate data which applies the edit pattern including the pattern of the selected data to the cutting or printing position, based on the selected data and the determined contents.

10. The medium according to claim 6, wherein the instructions, when executed by the control device, further cause the apparatus to specify the designated position while the holding member holding the object is positioned at the predetermined position.

* * * * *